US008909110B2

(12) United States Patent
Nishida

(10) Patent No.: US 8,909,110 B2
(45) Date of Patent: Dec. 9, 2014

(54) DEVELOPING DEVICE, PROCESS CARTRIDGE, AND IMAGE FORMING APPARATUS

(71) Applicant: Canon Kabushiki Kaisha, Tokyo (JP)

(72) Inventor: Shinichi Nishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 13/903,402

(22) Filed: May 28, 2013

(65) Prior Publication Data

US 2013/0322932 A1 Dec. 5, 2013

(30) Foreign Application Priority Data

May 30, 2012 (JP) ..... 2012-123497

(51) Int. Cl.
*G03G 15/08* (2006.01)
*G03G 21/18* (2006.01)

(52) U.S. Cl.
CPC ..... *G03G 15/0812* (2013.01); *G03G 21/1814* (2013.01); *G03G 2215/0132* (2013.01); *G03G 2221/1684* (2013.01)
USPC ..... 399/284

(58) Field of Classification Search
USPC ..... 399/284
See application file for complete search history.

(56) References Cited

U.S. PATENT DOCUMENTS

2012/0269545 A1* 10/2012 Morita et al. ..... 399/111

FOREIGN PATENT DOCUMENTS

JP 09-062096 A1 3/1997
JP 10-239991 A 9/1998
JP 2003280363 A * 10/2003

* cited by examiner

*Primary Examiner* — Quana M Grainger
(74) *Attorney, Agent, or Firm* — Canon USA Inc IP Division

(57) ABSTRACT

A developer regulating member is rotatably supported. A distance from the rotation center of the developer regulating member to the center of a developer carrying member is more than a distance from the center of a shaft portion to the leading edge of an elastic member and the bending angle β of the elastic member which is calculated from $\beta=PL^2/2EI$ is less than the set angle α of the elastic member with respect to the developer carrying member.

20 Claims, 11 Drawing Sheets

DEVELOPING DEVICE, PROCESS CARTRIDGE, AND IMAGE FORMING APPARATUS

BACKGROUND OF THE INVENTION

1. Field of the Invention

The present disclosure relates to a developing device and a process cartridge used in, for example, an electrophotographic type image forming apparatus or an electrostatic recording type image forming apparatus.

2. Description of the Related Art

An image forming apparatus, such as a printer using an electrophotographic process, uniformly charges an electrophotographic photosensitive member (hereinafter, simply referred to as a "photosensitive member") serving as an image carrying member. Then, the charged photosensitive member is selectively exposed to form an electrostatic image on the photosensitive member. Then, the electrostatic image formed on the photosensitive member is visualized as a toner image by toner which is a developer. Then, the toner image formed on the photosensitive member is transferred to a recording material, such as a recording sheet or a plastic sheet and heat or pressure is applied to the toner image transferred to the recording material to fix the toner image to the recording material. In this way, image recording is performed.

In general, in the image forming apparatus, it is necessary to supply a developer or maintain various kinds of process means. In order to facilitate the supply of the developer or the maintenance of various kinds of process means, for example, a technique has been put to practical use in which the photosensitive member, the charging unit, the developing unit, and the cleaning unit are arranged in a frame to form a process cartridge which is detachably attachable to an image forming apparatus body. According to the process cartridge type, it is possible to provide an image forming apparatus with high usability.

In the image forming apparatus, in some cases, a developing blade is used in the developing device (developing means) in order to regulate the thickness of a layer of the developer (toner) held in the developer carrying member (developing roller) to a predetermined thickness. The developing blade contacts the developing roller to triboelectrically charge toner and forms a toner layer with a predetermined thickness on the developing roller.

Next, a method of bringing the developing blade into contact with the developing roller will be described. There are two kinds of contact methods, that is, a so-called edge contact method of bringing the leading edge of the developing blade into contact with the developing roller and a so-called belly contact method of bringing the plane of the developing blade into contact with the developing roller.

However, in recent years, there is a demand for a reduction in power consumption in a fixing process with a reduction in the energy consumption of an apparatus. In order to reduce power consumption in the fixing process, it is effective to reduce the heat quantity required to melt toner, that is, the melting point of toner. However, the toner with a low melting point is easy to fix at a low temperature, but has low resistance to toner stress (load). When toner passes through the blade, heat or mechanical stress is applied to the toner. Therefore, when the toner with a low melting point is used for a long time, the adhesion of the toner is reduced. In order to solve the problem, in some cases, an external additive, such as mixed silica, is incorporated into toner. In addition, in some cases, wax in the toner bleeds to the surface, which increases the adhesion of toner. As a result, so-called developing blade melt-adhesion in which toner is attached to the toner is likely to occur. When the developing blade melt-adhesion occurs, the toner layer is not stably formed on the developing roller and a so-called "white stripe" is generated in the image. As a result, image quality is likely to be reduced.

When the above-mentioned developing blade comes into contact with the developing roller in the belly contact manner, a toner intake port is formed in front of a contact nip portion (contact region) between the developing roller and the blade, that is, on the upstream side of the contact nip portion in the rotation direction of the developing roller. Contact pressure between the developing blade and the developing roller is not generated in the toner intake port. Therefore, in general, even when toner is attached to the developing blade, it is possible to remove the attached toner using the flowing of toner in the toner intake port. However, when toner with a low melting point is used, the adhesion of the toner increases. Therefore, it is difficult to remove the toner attached to the developing blade using only the flowing of toner in the toner intake portion.

As a result, in the structure in which the developing blade comes into contact with the developing roller in the belly contact manner, the developing blade melt-adhesion is likely to occur on the upstream side of the contact nip portion between the developing roller and the developing blade in the rotation direction of the developing roller.

In order to solve the above-mentioned problems, it is preferable to use the edge contact method of bringing the leading edge of the developing blade into contact with the developing roller. In the related art, various methods and apparatuses have been proposed in order to bring the leading edge of the developing blade into contact with the developing roller.

For example, FIGS. 14 to 16 schematically show a portion of a developing device including the developing blade according to the related art.

Japanese Patent Application Laid-Open No. 09-062096 discloses a developing device with the structure shown in FIG. 14. In the developing device shown in FIG. 14, one end of a thin elastic member 221*a* is supported in a cantilever manner and an opposing portion, which is the other end, comes into contact with a developing roller 217. That is, the cantilever-supported thin elastic member 221*a* is a leaf spring with a free length X and is provided with bending by a distance Y to ensure the contact pressure of the thin elastic member 221*a* with the developing roller 217.

In addition, Japanese Patent Application Laid-Open No. 09-062096 discloses a developing device with the structure shown in FIG. 15. In the developing device shown in FIG. 15, a developing blade 321 which has a thickness of 2 mm to 4 mm and is made of a resin or a metal material with relative high hardness is attached to a blade guide through a coil spring 324 so as to be movable forward and backward. The developing blade 321 comes into pressure contact with a developing roller 317 which is rotated by the force of the coil spring 324 at predetermined pressure.

Japanese Patent Application Laid-Open No. 10-239991 discloses a developing device with the structure shown in FIG. 16. In the developing device shown in FIG. 16, one end of a plate-shaped member 421*a* has a curved surface. The other end of the plate-shaped member 421*a* is rotatably supported by a developing container through a fulcrum shaft 423. In addition, the plate-shaped member 421*a* is urged by a spring 424 to bring the curved surface of the plate-shaped member 421*a* into contact with the circumferential surface of the developing roller 417.

However, in the above-mentioned related art, it is difficult to prevent the developing blade melt-adhesion on the downstream side of the contact nip portion between the developing roller and the developing blade in the rotation direction of the developing roller. In addition, the related art has the problems to be solved.

In the developing device shown in FIG. 14, a predetermined amount of bending is set to the cantilever-supported thin elastic member 221*a*, which is a leaf spring, and the thin elastic member 221*a* is fixed to the developing container to ensure contact pressure with respect to the developing roller 217. Therefore, the leading edge and the ventral surface of the thin elastic member 221*a* need to contact the developing roller 217 at the same time. In this case, in a pressure distribution in the contact nip (contact region) between the thin elastic member 221*a* and the developing roller 227, contact pressure is low in a ventral surface portion on the downstream side of the contact nip portion in the rotation direction of the developing roller.

In a region with low contact pressure, toner or an external toner additive tends to stay. When there is a wide region with low contact pressure, it is difficult to remove the toner attached to the thin elastic member 221*a*. As a result, toner is melted and adhered to the developing blade on the downstream side of the contact nip portion between the developing roller 217 and thin elastic member 221*a* in the rotation direction of the developing roller.

However, a small amount of bending may be set to the thin elastic member 221*a* and the thin elastic member 221*a* may be fixed to the developing container such that only the vicinity of the leading edge of the thin elastic member 221*a* comes into contact with the developing roller 217. However, in this case, the amount of bending of the thin elastic member 221*a* is small. As a result, the contact pressure between the thin elastic member 221*a* and the developing roller 217 is unstable due to, for example, a variation in the dimensions or set position of the developing blade and the variation of the circumference of the developing roller 217 (a variation in the radius of the developing roller in the circumferential direction). Therefore, high-accuracy assembly is needed in order to set stable contact pressure.

In the developing device shown in FIG. 15, the gap of the developing blade 321 with respect to a blade guide occurs, which is a structural problem. Therefore, the developing blade 321 is inclined in the rotation direction of the developing roller 317 by frictional force in the contact portion between the developing blade 321 and the developing roller 317 and it is difficult to maintain a predetermined position. As a result, it is difficult to stably regulate a predetermined amount of toner on the developing roller 317.

In the developing device shown in FIG. 16, the plate-shaped member 421*a* has the curved surface and the curved surface comes into contact with the circumferential surface of the developing roller 417. In addition, the size of the toner intake port is increased by the curved surface. Therefore, the melt-adhesion of toner is likely to occur in the plate-shaped member 421*a* on the upstream side of the contact nip portion between the developing roller 417 and the plate-shaped member 421*a* in the rotation direction of the developing roller. When the curved surface comes into contact with the circumferential surface of the developing roller 417, a wide region with low contact pressure is formed on the downstream side of the contact nip portion in the rotation direction of the developing roller, in the pressure distribution in the contact nip portion. Therefore, the adhesion of toner is likely to occur in the developing blade on the downstream side of the contact nip portion between the developing roller 417 and the developing blade in the rotation direction of the developing roller.

When the size of the toner intake portion increases, the developing blade is lifted up by toner which flows into the intake port by the wedge effect. Therefore, the load required for regulation needs to increase in order to coat a thin toner layer. When the load applied from the developing blade to the developing roller 417 increases, mechanical stress applied to toner also increases. As a result, toner is likely to deteriorate and the adhesion of the toner increases. Therefore, toner is likely to be melted and adhered to the developing blade.

SUMMARY OF THE INVENTION

The disclosure has been made in order to solve the above-mentioned problems. That is, an object of the disclosure is to provide a developing device and a process cartridge capable of preventing a developer from being melted and adhered to a developer regulating member.

In order to achieve the object, a representative structure according to the application as follows.

A developing device used in an image forming apparatus includes:

a developer carrying member that carries a developer to develop an electrostatic latent image formed on an image carrying member;

a developer regulating member that includes a plate-shaped elastic member, is rotatably supported, and brings the elastic member into contact with the developer carrying member such that a leading edge of the elastic member faces an upstream side, in a rotation direction, of the developer carrying member to regulate the amount of developer held in the developer carrying member; and an urging portion that applies a moment to the developer regulating member to bring the developer regulating member into pressure contact with the developer carrying member.

A distance from a rotation center of the developer regulating member to a center of the developer carrying member is set to be more than a distance from the rotation center of the developer regulating member to the leading edge of the elastic member.

When a load received by the developer regulating member due to contact between the developer carrying member is P(N), a free length of the developer regulating member is L (m), a Young's modulus of the developer regulating member is E (Pa), a second moment of area of the developer regulating member is I ($m^4$)

and an angle formed between the elastic member and a tangent line to the developer carrying member in a contact portion between the leading edge of the developer regulating member and the developer regulating member at the time when the elastic member comes into contact with the developer carrying member without receiving the load is a set angle $\alpha$ (rad), a bending angle $\beta$ of the elastic member calculated from the following Expression 1 is less than the set angle $\alpha$:

$$\beta = PL^2/2EI \quad (1)$$

Further features of the present invention will become apparent from the following description of exemplary embodiments (with reference to the attached drawings).

DESCRIPTION OF THE EMBODIMENTS

<Embodiment 1>

Hereinafter, embodiments of the application will be described in detail with reference to the accompanying drawings.

[Electrophotographic Image Forming Apparatus]

Figure 2:
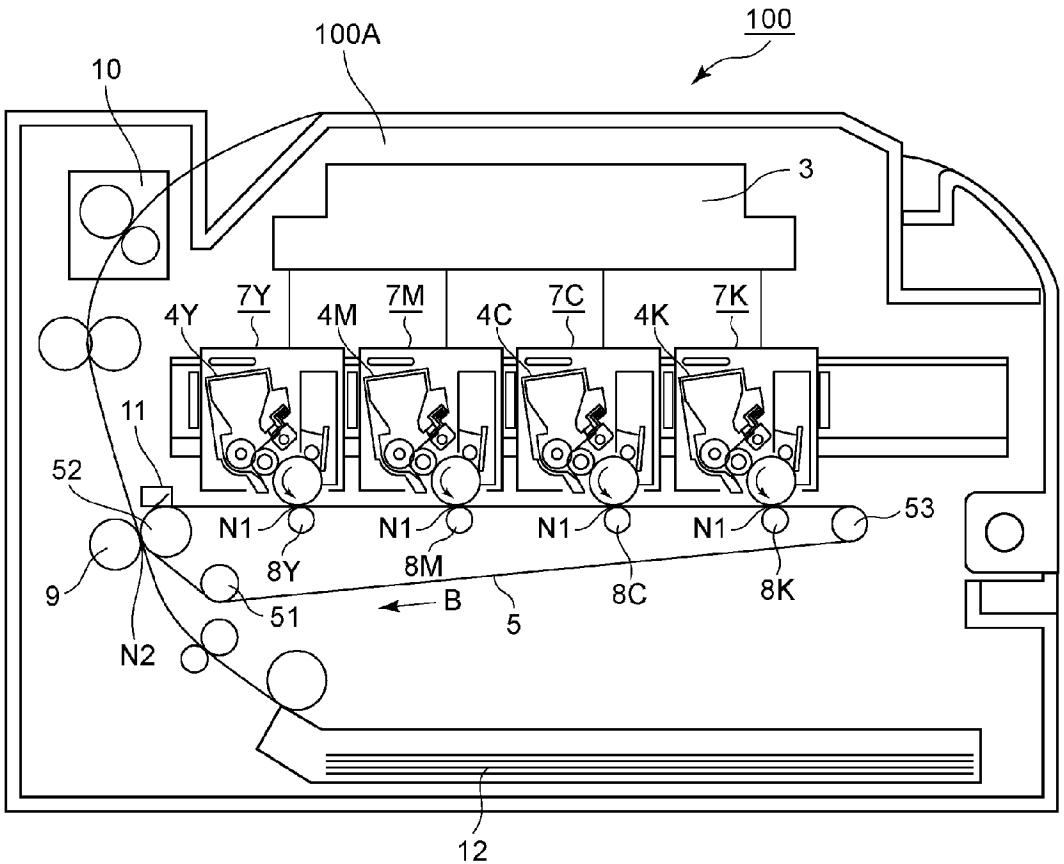
FIG. 2 is a schematic cross-sectional view illustrating an image forming apparatus body.
Figure 3:
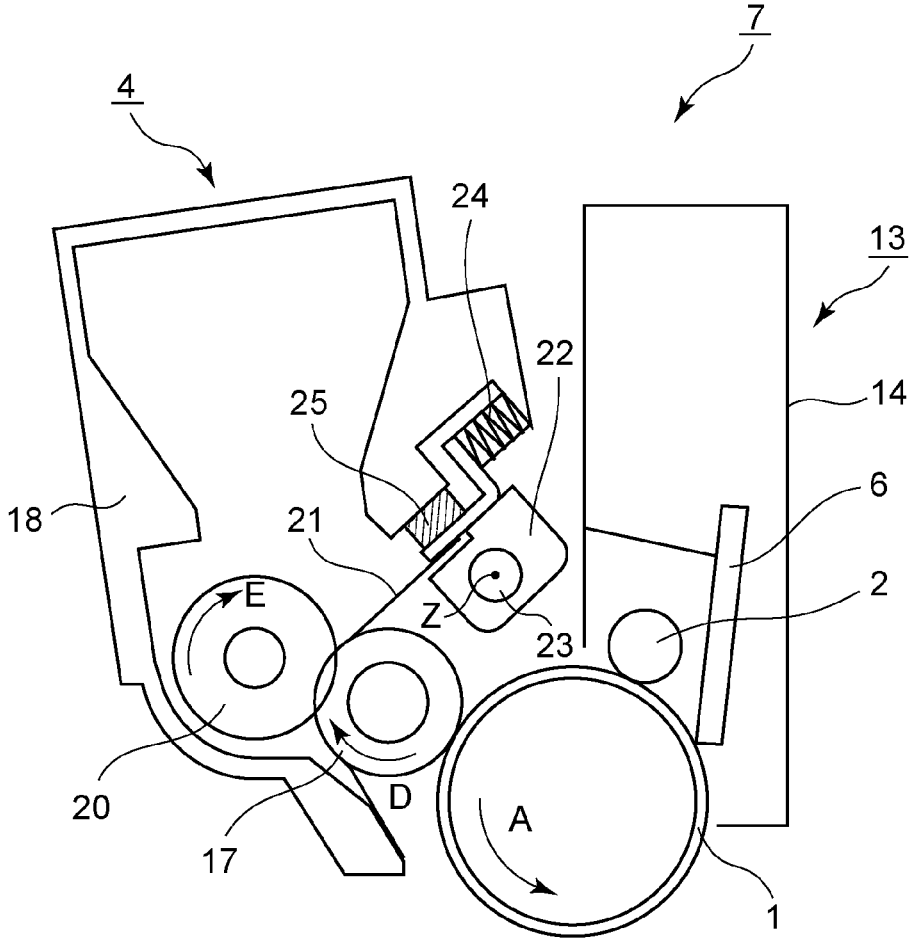
FIG. 3 is a schematic cross-sectional view illustrating a process cartridge.

First, an image forming apparatus to which a process cartridge according to this embodiment is detachably attachable will be described with reference to FIGS. 2 and 3. FIG. 2 is a schematic cross-sectional view illustrating an image forming apparatus 100 according to this embodiment and FIG. 3 is a schematic cross-sectional view illustrating a process cartridge 7 according to this embodiment. The image forming apparatus 100 according to this embodiment is a full color laser printer using an in-line method and an intermediate transfer method. The image forming apparatus 100 can form a full color image on a recording material 12 (for example, a recording sheet, a plastic sheet, or a cloth) on the basis of image information. The image information is input from an image reading device connected to an image forming apparatus body or a host apparatus, such as a personal computer which is connected to the image forming apparatus body such that it can communicate therewith, to the image forming apparatus body.

The image forming apparatus 100 includes first to fourth image forming units for forming yellow (Y), magenta (M), cyan (C), and black (K) images as a plurality of image forming units. In this embodiment, the first to fourth image forming units are arranged as first to fourth process cartridges 7Y, 7M, 7C, and 7K in a line in a direction intersecting the vertical direction.

In this embodiment, the first to fourth image forming units have substantially the same structure and operation except for the colors of images to be formed. Therefore, when the first to fourth image forming units do not need to be distinguished from each other, the suffixes Y, M, C, and K which are given to indicate elements for colors are omitted and the first to fourth image forming units are generically described.

That is, in this embodiment, the image forming apparatus 100 includes, as a plurality of image carrying members, four drum-type electrophotographic photosensitive members, that is, photosensitive drums 1 which are arranged in the direction intersecting the vertical direction. The photosensitive drums 1 are rotated in the direction (clockwise direction) of an arrow A which is shown in the drawings by a driving unit (driving source (not shown)). A charging roller 2 that serves as a charging means for uniformly charging the surface of the photosensitive drum 1 and a scanner unit (exposure device) 3 that serves as an exposure means for emitting a laser beam onto the photosensitive drum 1 on the basis of the image information and forming an electrostatic image (electrostatic latent image) on the photosensitive drum 1 are arranged in the vicinity of the photosensitive drum 1. In addition, a developing unit (developing device) 4 that serves as a developing means for developing the electrostatic image as a toner image and a cleaning member 6 that serves as a cleaning means for removing toner (residual toner) remaining on the surface of the photosensitive drum 1 after transfer are arranged in the vicinity of the photosensitive drum 1. Furthermore, an intermediate transfer belt 5 that serves as an intermediate transfer member for transferring the toner image on the photosensitive drum 1 to a recording material 12 is arranged so as to face the four photosensitive drums 1. In the rotation direction of the photosensitive drum 1, the charging position of the charging roller 2, the exposure position of the scanner unit 3, the developing position of the developing unit 4, the transfer position of the toner image to the intermediate transfer belt 5, and the cleaning position of the cleaning member 6 are set in this order.

In this embodiment, the developing unit 4 uses a non-magnetic one-component developer, that is, toner as a developer. In this embodiment, the developing unit 4 brings a developing roller (which will be described below) as a developer carrying member into contact with the photosensitive drum 1 to perform reversal developing. That is, in this embodiment, the developing unit 4 attaches toner which is charged with the same polarity (a negative polarity in this embodiment) as the charging polarity of the photosensitive drum 1 to a portion (an image portion or an exposed portion) of the photosensitive drum 1 in which charge is attenuated by exposure. In this way, the electrostatic image (electrostatic latent image) formed on the photosensitive drum 1 is developed.

In this embodiment, the photosensitive drum 1, and the charging roller 2, the developing unit 4, and the cleaning member 6 serving as process means acting on the photosensitive drum 1 are integrated into a cartridge and form the process cartridge 7. The process cartridge 7 can detachably attachable to an apparatus body 100A of the image forming apparatus 100 through mounting means, such as a mounting guide and a positioning member, provided in the apparatus body 100A. The apparatus body 100A is a portion of the image forming apparatus 100 except for the process cartridge 7.

In this embodiment, the process cartridges 7 for each color have the same shape and yellow (Y), magenta (M), cyan (C), and black (K) toners are accommodated in the process cartridges 7 for each color.

The intermediate transfer belt 5 serving as the intermediate retransfer member is an endless belt. The entire intermediate transfer belt 5 comes into contact with the photosensitive drum 1 and is circulated (rotated) in the direction (clockwise direction) of an arrow B which is shown in the drawings. The intermediate transfer belt 5 is wound around a driven roller 51, an opposing roller 52 for secondary-transfer, and a driving roller 53 as a plurality of supporting members.

Four primary transfer rollers 8 serving as primary transfer means are arranged in parallel on the inner peripheral surface side of the intermediate transfer belt 5 so as to be opposite to each photosensitive drum 1, with the intermediate transfer belt 5 interposed therebetween. The primary transfer roller 8 presses the intermediate transfer belt 5 to the photosensitive drum 1 to form a primary transfer portion N1 where the intermediate transfer belt 5 and the photosensitive drum 1 contact each other. A primary transfer bias power supply (high voltage power supply) serving as a primary transfer bias applying means (not shown) applies a bias with a polarity opposite to the normal charging polarity of toner to the primary transfer roller 8. In this way, the toner image on the photosensitive drum 1 is transferred (primarily transferred) onto the intermediate transfer belt 5.

On the outer peripheral surface side of the intermediate transfer belt 5, a secondary transfer roller 9 serving as a secondary transfer means is arranged at a position that is opposite to an opposing roller 52 for secondary-transfer with the intermediate transfer belt 5 interposed therebetween. The secondary transfer roller 9 comes into pressure contact with the opposing roller 52 for secondary-transfer through the intermediate transfer belt 5 to form a secondary transfer portion N2 where the intermediate transfer belt 5 and the secondary transfer roller 9 contact each other. A secondary transfer bias power supply (high voltage power supply) serving as a second transfer bias applying means (not shown) applies a bias with a polarity opposite to the normal charging polarity of toner to the secondary transfer roller 9. In this way, the toner image on the intermediate transfer belt is transferred (secondarily transferred) onto the recording material 12. The primary transfer roller 8 and the secondary transfer roller 9 have the same structure.

When an image is formed, first, the surface of the photosensitive drum 1 is uniformly charged by the charging roller 2. Then, the surface of the charged photosensitive drum 1 is scanned and exposed with laser light corresponding to the image information which is emitted from the scanner unit 3 and an electrostatic image corresponding to the image information is formed on the photosensitive drum 1. Then, the electrostatic image formed on the photosensitive drum 1 is developed into a toner image by the developing unit 4. The toner image formed on the photosensitive drum 1 is transferred (primarily transferred) onto the intermediate transfer belt 5 by the operation of the primary transfer roller 8.

For example, when a full color image is formed, the above-mentioned process is sequentially performed in the first to fourth image forming units (process cartridges 7Y, 7M, 7C, and 7K) and toner images of each color are sequentially superimposed on the intermediate transfer belt 5 and are primarily transferred.

Then, the recording material 12 is conveyed to the secondary transfer portion N2 in synchronization with the movement of the intermediate transfer belt 5 and four color toner images on the intermediate transfer belt 5 are collectively secondarily transferred onto the recording material 12 by the operation of the secondary transfer roller 9 which comes into contact with the intermediate transfer belt 5 through the recording material 12.

The recording material 12 having the toner images transferred thereto is conveyed to a fixing device 10 serving as a fixing means. The fixing device 10 applies heat and pressure to the recording material 12 to fix the toner images to the recording material 12.

The primary-transfer remaining toner which remains on the photosensitive drum 1 after the primary transfer process is removed by the cleaning member 6 and is then collected. The secondary-transfer remaining toner which remains on the intermediate transfer belt 5 after the secondary transfer process is cleaned by an intermediate transfer belt cleaning device 11.

However, the image forming apparatus 100 is configured such that only one or some (not all) desired image forming units are used to form a monochrome or multi-color image.

[Process Cartridge]

Next, the overall structure of the process cartridge 7 attached to the apparatus body 100A of the image forming apparatus 100 according to this embodiment will be described.

However, in the specification, for the structure or operation of the developing unit (developing device) 4 or the process cartridge 7, the terms indicating the directions, such as the upper side, the lower side, the vertical direction, and the horizontal direction, indicate directions in the normal use state of the developing unit 4 or the process cartridge 7 unless otherwise noted. The normal use state of the developing unit (developing device) 4 or the process cartridge 7 means a state in which the developing unit (developing device) 4 or the process cartridge 7 is appropriately attached to the apparatus body 100A of the image forming apparatus 100 which is appropriately arranged and is provided to an image forming operation.

FIG. 3 is a schematic cross-sectional view (a main cross-sectional view) illustrating the process cartridge 7 according to this embodiment as viewed from the longitudinal direction (rotation axial line direction) of the photosensitive drum 1. In this embodiment, the process cartridges 7 for each color have the same structure and operation except for the type (color) of developers accommodated therein.

The process cartridge 7 includes a photosensitive unit 13 including, for example, the photosensitive drum 1 and a developing unit 4 including, for example, a developing roller 17.

The photosensitive unit 13 includes a cleaning frame 14 which is a frame for supporting each component in the photosensitive unit 13. The photosensitive drum 1 is rotatably attached to the cleaning frame 14 through a bearing (not shown). When the driving force of a driving motor provided in the apparatus body 100A is transmitted to the photosensitive unit 13, the photosensitive drum 1 is rotated in the direction (counterclockwise direction) of the arrow A which is shown in the drawings in response to an image forming operation. The photosensitive drum 1, which is the center of the image forming process, is an organic photosensitive drum formed by coating a functional film on the outer peripheral surface of an aluminum cylinder. The functional film is a film which gives a function required to form an image to the photosensitive drum 1. In this embodiment, the functional film includes an undercoating layer, a carrier generating layer, and a carrier transport layer in this order from the aluminum cylinder. The rotation speed of the photosensitive drum 1 when an image is formed is 100 mm/sec.

In addition, a cleaning member 6 and a charging roller 2 are arranged in the photosensitive unit 13 so as to contact the circumferential surface of the photosensitive drum 1. The residual toner which is removed from the surface of the photosensitive drum 1 by the cleaning member 6 falls into the cleaning frame 14 and is then accommodated therein.

A roller portion made of conductive rubber in the charging roller 2, which is a charging means, comes into pressure contact with the photosensitive drum 1 and the charging roller 2 is rotated with the rotation of the photosensitive drum 1. In a charging process of charging the photosensitive drum 1, a direct current voltage that is −1100 V with respect to the photosensitive drum 1 is applied to a core metal of the charging roller 2. In this way, a uniform dark area potential (Vd) of about −550 V is formed on the surface of the photosensitive drum 1.

The photosensitive drum is exposed by the spot pattern of the laser light which emitted from the scanner unit 3 in correspondence with image data, and charge in the surface of the exposed portion is lost by the carriers generated from the carrier generating layer, which results in a reduction in potential. As a result, the potential of the exposed portion is a bright area potential V1 of −100 V and the potential of the non-exposed portion is a dark area potential Vd of −550 V. Therefore, an electrostatic latent image is formed on the photosensitive drum 1.

[Developing Unit (Developing Device)]

Next, a developing unit (developing device) used in this embodiment will be described.

The developing unit 4 includes a developing frame 18 which is a frame for supporting each component in the developing unit 4. The developing unit 4 is provided with a developing roller 17 serving as a developer carrying member that comes into contact with the photosensitive drum 1 and is rotated in the direction (clockwise direction) of an arrow D shown in the drawings. In this embodiment, the developing roller 17 and the photosensitive drum 1 are rotated such that the surfaces thereof are moved in the same direction (a direction from the upper side to the lower side in this embodiment) in an opposing portion (contact portion). In addition, the rotation speed of the developing roller 17 is set to be about 1.3 times the rotation speed of the photosensitive drum 1.

Both ends of the developing roller 17 in the longitudinal direction (rotation axial line direction) are rotatably supported by the developing frame 18 through a developing side plate (not shown). In this embodiment, the developing roller 17 is arranged so as to contact the photosensitive drum 1. However, the developing roller 17 may be arranged close to the photosensitive drum 1 with a predetermined gap therebetween.

In this embodiment, toner which is negatively charged by triboelectric charging with respect to a DC bias of −350 V applied to the developing roller 17 is transferred only to a bright area potential portion due to the potential difference in a developing portion which comes into contact with the photosensitive drum 1 and an electrostatic latent image is visualized. The toner used is a non-magnetic one-component toner and this embodiment is a reversal development system for transferring toner to an exposed portion.

The developing roller 17 is an elastic developing roller including an elastic layer formed on a core metal. In this embodiment, a first layer (base layer) which is made of solid rubber obtained by dispersing carbon in silicone rubber is formed with a thickness of about 3 mm on the core metal which has a diameter of 6 mm and is made of stainless steel. In addition, as a second layer (surface layer), acrylic urethane-based rubber whose resistance is adjusted by a conducting agent is formed with a thickness of about 10 μm. The ASKER-C hardness of the developing roller 17 is in the range of 45° to 65° and micro-rubber hardness measured by MD-1 (micro-rubber hardness meter (manufactured by KOBUNSHI KEIKI CO., LTD.)) is in the range of 35° to 50°. The resistance (electric resistance) of the developing roller 17 is in the range of 104 Ω to 106 Ω.

An appropriate unevenness is provided in the surface of the developing roller 17 in order to improve sliding friction with toner and the transportability of toner and center line average roughness Ra is in the range of 0.6 μm to 2.8 μm.

A toner supply roller 20 serving as a developer feed member which is rotated in the direction (clockwise direction) of an arrow E in the drawings is provided in the developing unit 4 so as to come into contact with the circumferential surface of the developing roller 17. That is, in this embodiment, the toner supply roller 20 and the developing roller 17 are rotated such that the surfaces thereof are moved in the opposite direction in an opposing portion (contact portion). The peripheral speed of the surface of the toner supply roller 20 is 0.85 times the peripheral speed of the surface of the developing roller 17.

The toner supply roller 20 supplies toner onto the developing roller 17 and removes the toner which has not been supplied to development, but has remained on the developing roller 17 from the developing roller 17. In addition, a developing blade 21 serving as a developer regulating member that regulates the layer thickness of the toner supplied onto the developing roller 17 by the toner supply roller 20 is provided in the developing unit 4 so as to come into contact with the circumferential surface of the developing roller 17.

The toner supply roller 20 is formed by depositing foam in the outer circumference of a conductive core metal. Hereinafter, the layer in which foam is formed is referred to as a foam layer. The foam layer of the toner supply roller 20 has a function of supplying toner to the developing roller 17 and a function of removing the toner which does not contribute to development from the developing roller 17. The rim of a foam cell formed in the foam layer of the supply roller 20 frictionally slides on the developing roller 17 to remove toner on the developing roller 17.

In this embodiment, in the toner supply roller 20, the outside diameter of the core metal is ϕ5 mm. In addition, as the foam layer, polyurethane foam which has foam frame structure and has relatively low hardness is formed on the core metal. The thickness of the foam layer is 5.5 mm and a foam cell with a diameter of 300 μm to 450 μm is formed. That is, the toner supply roller 20 according to this embodiment is an elastic sponge roller with an outside diameter of ϕ16 mm.

Since the outer circumferential portion of the toner supply roller 20 is formed of foam, the toner supply roller 20 contacts the developing roller 17 without applying excessive pressure. The appropriate unevenness in the surface of the foam is used to supply toner onto the developing roller 17 and to remove the toner which has remained without being consumed during development from the developing roller.

The material which scrapes away the toner using the foam frame structure is not limited to urethane foam. For example, the foam (foam layer) used in the toner supply roller 20 may be made of generally used rubber, such as NBR rubber, silicone rubber, acrylic rubber, hydrin rubber, ethylene-propylene rubber (EPDM), chloroprene rubber, styrene-butadiene rubber, isoprene rubber, acrylonitrile-butadiene rubber, and complex mixtures thereof.

In addition, in order to adjust the resistance (electric resistance) of the foam layer, a known ion conducting agent, inorganic fine particles, or carbon black may be appropriately dispersed in the foam layer.

A bias for urging toner from the toner supply roller 20 to the developing roller 17 may be applied to the toner supply roller 20 in order to assist the supply of toner to the developing roller 17. A bias for urging the negatively charged toner to the developing roller 17 may be applied to increase the amount of toner held by the developing roller 17 before the developing blade 21. The bias makes it easy to improve the density of toner on the developing roller 17 and to obtain uniform toner density even when the surface roughness of the developing roller 17 is low.

In this embodiment, toner with a substantially spherical shape is used as a negatively-charged non-magnetic toner 32, which is a one-component developer, in order to improve image quality, reduce the diameter of particles, and improve the efficiency of transfer. Specifically, toner with a shape factor SF-1 of 100 to 180 and a shape factor SF-2 of 100 to 140 is used.

SF-1 and SF-2 defines the values obtained by sampling 100 toner images at random using FE-SEM (S-800) manufactured by Hitachi, Ltd., introducing image information of the toner images into an image analysis apparatus (Lusex3) manufactured by Nireco Corporation, and analyzing the image information. The values are calculated by the following expression.

$$SF\text{-}1=\{(MXLNG)^2/AREA\}\times(\pi/4)\times 100$$

$$SF\text{-}2=\{(PERI)^2/AREA\}\times(\pi/4)\times 100$$

(where MXLNG is the maximum length of the shape capable of projecting toner onto a two-dimensional surface, AREA is the area of the shape capable of projecting toner onto the two-dimensional surface, and PERI is the circumferential length of the shape capable of projecting toner onto the two-dimensional surface).

The shape factor SF-1 of the toner indicates the degree of sphericity of a toner particle. As the shape factor SF-1 increases from 100, sphericity is gradually changed to an indefinite shape. The shape factor SF-2 indicates the degree of unevenness of the toner particle. As the shape factor SF-2 increases from 100, the unevenness of the surface of the toner increases.

A toner manufacturing method is not particularly limited as long as toner is within the above-mentioned shape factor range. For example, thermal or mechanical stress may be applied to the surface of powder toner according to the related art to make spherical toner particles. In addition, toner may be directly manufactured by a suspension polymerization method. A dispersion polymerization method or an emulsion polymerization method typified by a soap-free polymerization method may be used.

In this embodiment, styrene and n-butyl acrylate are used as monomers, a metal complex of salicylic acid is used as a charge control agent, and saturated polyester is used as polar resin. In addition, a coloring agent is added to them and suspension polymerization is performed under ordinary pressure or increased pressure. In this way, it is possible to relatively easily perform control such that the shape factor SF-1 of toner is in the range of 100 to 180 and the shape factor SF-2 is in the range of 100 to 140. As a result, the particle size distribution of toner is sharpened and the main particle diameter of toner falls within the range of 4 μm to 8 μm. The weight average particle diameter of toner may be equal to or less than 10 μm and preferably equal to or less than 7 μm.

The weight average particle diameter of toner is measured using a Coulter Counter TA-II or a Coulter multisizer (manufactured by Coulter Electronics Limited). A NaCl aqueous solution which uses primary sodium chloride as a solute and whose density is adjusted to 1% is used as an electrolytic solution used in the measurement.

As a dispersant, 0.1 ml to 5 ml of a surfactant, preferably, alkylbenzene sulfonic acid salt is added to 100 ml to 150 ml of electrolytic solution and 2 mg to 20 mg of measurement sample is added thereto. The electrolytic solution including the sample added is dispersed in an ultrasonic dispersion device for about 1 to 3 minutes and the volume and the number of toner particles with a size equal to or more than 2 μm are measured by the measuring device using an aperture of 100 μm. Then, a volume distribution and a number distribution are calculated and a weight average particle diameter D4, which is a weight reference, is calculated from the volume distribution.

Then, 1.5 wt % of hydrophobic silica is added as a fluidity imparting agent. The amount of hydrophobic silica added is not limited thereto. The surface of toner is coated with an external additive to improve a negative charging performance and provide a very small gap between the toner particles, thereby improving fluidity.

The above-mentioned structure of the image forming apparatus is an illustrative example for describing the embodiment of the invention, but the invention is not limited thereto.

[Toner Regulation Member]

Figure 1:
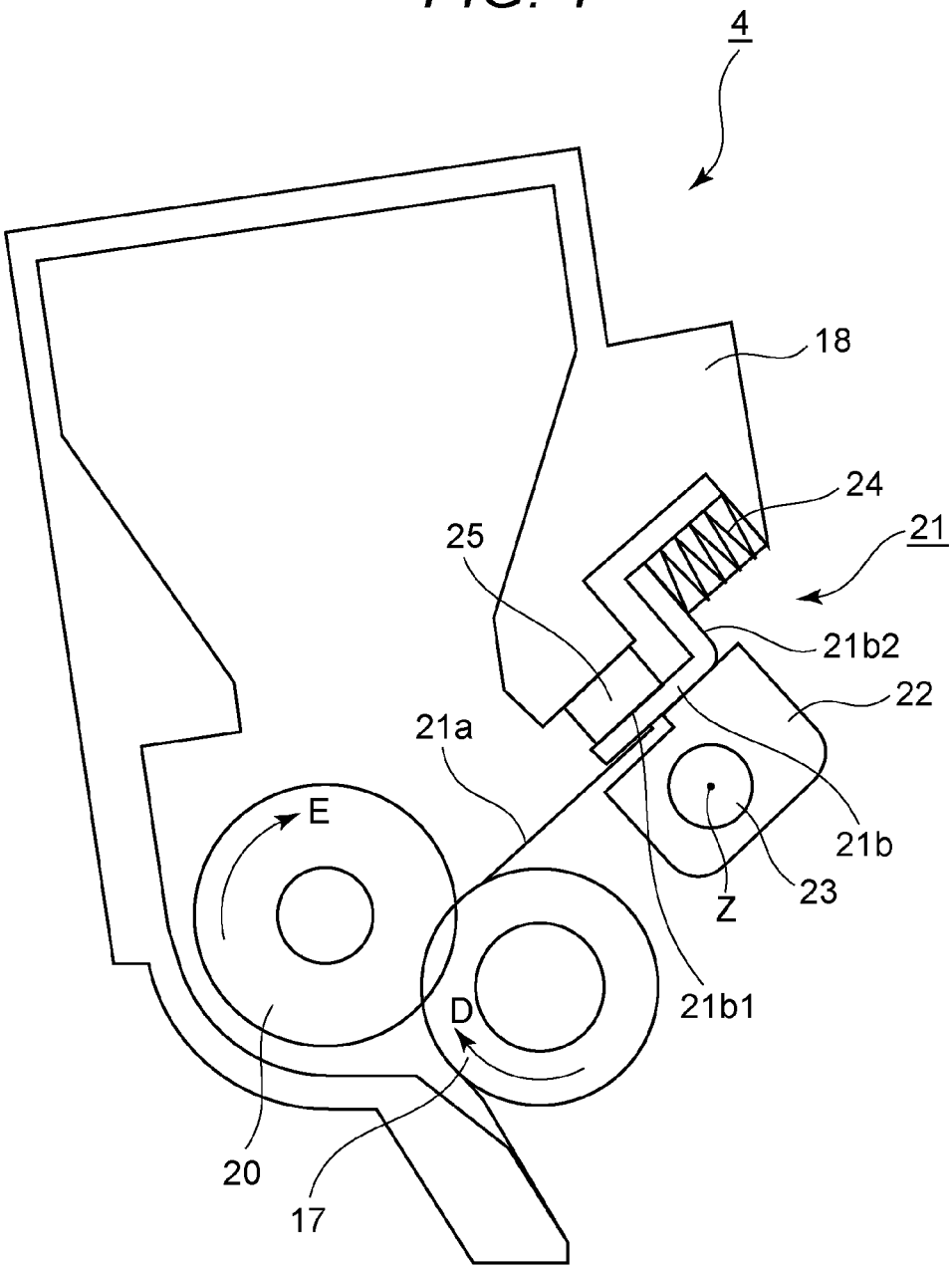
FIG. 1 is a schematic cross-sectional view illustrating a developing device.

Next a toner regulation member (developer regulating member) according to this embodiment will be described. FIG. 1 is a diagram illustrating the schematic structure of the developing unit.

The developing blade 21 serving as the toner regulation member is arranged so as to come into contact with the developing roller 17 on the downstream side of the toner supply roller 20 in the rotation direction D of the developing roller 17. The developing blade 21 includes a thin elastic member 21*a* and a supporting metal plate 21*b* that supports the thin elastic member 21*a*. The free end of the thin elastic member 21*a* is supported in a cantilever manner by the supporting metal plate 21*b* so as be directed from the downstream side to the upstream side in the rotation direction D of the developing roller 17. The thin elastic member 21*a* is an elastic member (leaf spring) made of thin plate-shaped metal.

The supporting metal plate 21*b* is a metal plate thicker than the thin elastic member 21*a*, is bent in an L-shape, and is attached to a pivotal movement frame 22. The supporting metal plate 21*b* is a supporting member that supports the thin elastic member 21*a*.

The pivotal movement frame 22 is a frame which has pivotal movement fulcrum shafts 23 at both ends thereof in the longitudinal direction (the axial line direction of the developing roller 17). The pivotal movement fulcrum shaft 23 is a shaft portion which enables the pivotal movement frame 22 to rotate and is supported by the developing frame 18. That is, the developing side plate provided in the developing frame 18 supports the pivotal movement fulcrum shaft 23 so as to be rotatable, in addition to the developing roller 17. Therefore, the pivotal movement frame 22 can be rotated about the axial line z of the pivotal movement fulcrum shaft 23.

As a result, the developing blade 21 can be rotated integrally with the pivotal movement frame 22 about the axial line z of the pivotal movement fulcrum shaft 23 with respect to the developing frame 18. In this embodiment, the supporting metal plate 21*b* is attached to the pivotal movement frame 22. However, the pivotal movement fulcrum shaft 23 may be directly provided in the supporting metal plate 21*b* to support the developing blade 21 so as to be rotatable with respect to the developing frame 18.

A sealing member 25 for preventing the leakage of toner is provided between the developing frame 18 and the developing blade 21 in the longitudinal direction (the axial line direction of the developing roller 17) of the developing blade 21. The sealing member 25 is attached to a seating surface (attachment surface) which is provided as a portion of the developing frame 18. The sealing member is compressed at a predetermined pressure by the developing blade 21 to prevent the leakage of toner between the developing frame 18 and the developing blade 21. In this embodiment, foam of an EPDM (ethylene propylene rubber) compound is used as the sealing member 25.

Next, the pressing force of the developing blade 21 against the developing roller 17 will be described with reference to FIG. 4. A pressurizing spring 24 which presses the pivotal movement frame 22 is provided in the developing frame 18 and applies moment to the pivotal movement frame 22 and the developing blade 21 using the axial line z of the pivotal movement fulcrum shaft 23 as the center of rotation center. That is, the pressurizing spring 24 contacts the supporting metal plate 21*b* which is bent an L-shape to apply force Fs. In this way, moment in the counterclockwise direction is applied to the developing blade 21 and the pivotal movement frame 22. As a result, the developing blade 21 is pressed against the developing roller 17.

In this embodiment, as shown in the drawings, the pressurizing spring 24 is a compressed spring. However, a method of pressing the developing blade 21 is not particularly limited. A pressing method using, for example, an extension coil spring or a leaf spring, not the compressed spring, may be applied.

The moment having the axial line z of the pivotal movement fulcrum shaft 23 as the center of rotation is applied to press the developing blade 21 against the developing roller 17. However, the pressing force of the developing blade 21 against the developing roller 17 is determined by the balance of the moment of force having the axial line z of the pivotal movement fulcrum shaft 23 as the center and is calculated by the following Expression 1.

$$FdLd \sin \theta d = FsLs \sin \theta s + FslLsl \sin \theta sl \qquad \text{Expression (1)}$$

Each symbol is defined as follows:

Fd: the pressing force of the developing roller 17 and the developing blade 21;

Ld: a distance from the center (axial line z) of the pivotal movement fulcrum shaft 23 to a contact portion between the developing roller 17 and the developing blade 21;

θd: an angle formed between the direction of Fd and a line connecting the center (axial line z) of the pivotal movement fulcrum shaft 23 and the contact portion between the developing roller 17 and the developing blade 21;

Fs: the load of the pressurizing spring 24 applied to the pivotal movement frame 22;

Ls: a distance from the center of the pivotal movement fulcrum shaft 23 to the contact portion between the pressurizing spring 24 and the pivotal movement frame 22;

θs: an angle formed between the direction of Fs and a line connecting the center of the pivotal movement fulcrum shaft 23 and a contact point between the pressurizing spring 24 and the pivotal movement frame 22;

Fsl: the load of the sealing member 25 applied to the pivotal movement frame 22;

Lsl: a distance from the center of the pivotal movement fulcrum shaft 23 to a contact portion between the sealing member 25 and the pivotal movement frame 22; and θsl: an angle formed between the direction of Fsl and a line connecting the center of the pivotal movement fulcrum shaft 23 and a contact point between the sealing member 25 and the pivotal movement frame 22.

Figure 4:
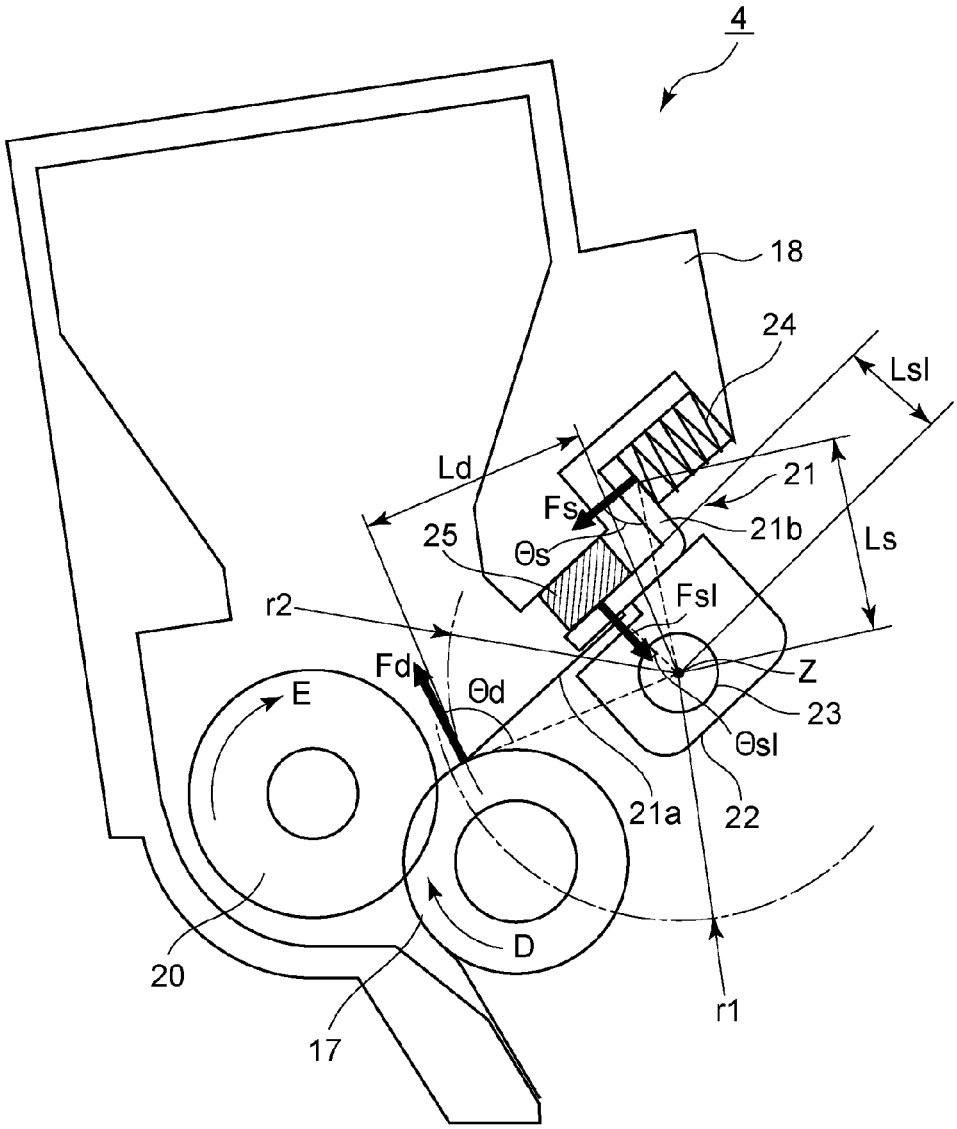
FIG. 4 is a schematic cross-sectional view of the developing device illustrating force acting on a developing blade.

As shown in FIG. 4, Fd is a load which is received by the developing blade 21 from the contact portion with the developing roller 17 and is equal to the pressing force of the developing blade 21 against the developing roller 17. Fs is generated in the direction in which the pressurizing spring 24 is stretched from the contact portion between the pressurizing spring 24 and the pivotal movement frame 22.

In this embodiment, the distance Lsl from the axial line z of the pivotal movement fulcrum shaft 23 to the contact portion between the sealing member 25 and the pivotal movement frame 22 is set to a small value.

Therefore, the term of the moment of force by the sealing member 25 is omitted in calculation. That is, in Expression 1, Fsl·Lsl·sin θsl=0 is established.

$$Fsl \cdot Lsl \cdot \sin \theta sl = 0$$

The left side of Expression 1 is the moment in the clockwise direction having the axial line z of the pivotal movement fulcrum shaft 23 as the center in FIG. 4 and the right side of Expression 1 is the moment in the counterclockwise direction having the axial line z as the center. Expression 1 is established in a state in which the developing blade 21 is pressed against the developing roller 17 by the pressurizing spring 24.

The force Fd of the developing roller 17 applied to the developing blade 21 is calculated from Ld, θd, Fs, Ls, θs, Fs, Fsl, and Lsl by Expression 1. That is, for example, the structure and arrangement of the pressurizing spring 24 or the pivotal movement frame 22 are changed to set the pressing force of the thin elastic member 21*a* of the developing blade 21 against the developing roller 17 to a value suitable to form an image.

The pressurizing spring 24 is not attached to the thin elastic member 21*a*, but is attached to the supporting metal plate 21*b*. The reason is as follows. When the pressurizing spring 24 directly urges the thin elastic member 21*a*, the thin elastic member 21*a* is prevented from being deformed. In particular, in this embodiment, the supporting metal plate 21*b* is a metal plate thicker than the thin elastic member 21*a* and is bent in an L-shape. Therefore, the supporting metal plate 21*b* has high strength and is less likely to be deformed even when urging force is received from the pressurizing spring 24. In this way, the deformation of the supporting metal plate 21*b* is prevented. As a result, the pressing force of the thin elastic member 21*a* of the developing blade 21 against the developing roller 17 is maintained to be uniform.

In this embodiment, since the supporting metal plate 21*b* is bent, a first surface 21*b*1 to which the thin elastic member 21*a* is attached and a second surface 21*b*2 which receives urging force from the pressurizing spring 24 intersect each other (the first and second surfaces are substantially perpendicular to each other in this embodiment). Therefore, even when the second surface 21*b*2 is deformed by the urging force from the pressurizing spring 24, the influence of the second surface 21*b*2 on the thin elastic member 21*a* is prevented.

There is a little gap between the developing frame 18 and the pivotal movement fulcrum shaft 23 of the pivotal movement frame 22 supporting the developing blade 21 such that the pivotal movement fulcrum shaft 23 can be rotated. Therefore, when the leading edge of the thin elastic member 21*a* receives force from the developing roller 17, the pivotal movement frame 22 and the developing blade 21 move a distance corresponding to the gap and is likely to have an effect on the contact state between the thin elastic member 21*a* and the developing roller 17.

However, in this embodiment, since the surface 21*b*2 is bent with respect to the surface 21*b*1 in the supporting metal plate 21*b*, the force Fs applied from the pressurizing spring 24 to the developing blade 21 is generated in the direction in which the thin elastic member 21*a* extends from the supporting metal plate 21*b* to the developing roller 17.

That is, the force Fs acts in the direction in which the leading edge of the thin elastic member 21*a* approaches the developing roller 17. Therefore, even when the thin elastic member 21*a* receives force from the developing roller 17, it is possible to prevent the leading edge of the thin elastic member 21*a* from moving in a direction in which it is separated from the developing roller 17. As a result, it is possible to maintain the good contact state between the thin elastic member 21*a* and the developing roller 17.

In particular, in this embodiment, the direction in which the force Fs of the pressurizing spring 24 is generated is substantially parallel to the thin elastic member 21*a*. However, the direction is not necessarily parallel to the thin elastic member 21*a*, but may be aligned with a direction in which the thin elastic member 21*a* extends to the developing roller 17.

Next, the setting of the position of the leading edge on the free end side of the thin elastic member 21*a* according to this embodiment will be described. For description, it is assumed that the distance from the center (axial line z) of the pivotal movement fulcrum shaft 23 to the rotation center of the developing roller 17 is r1 and the distance from the center (axial line z) of the pivotal movement fulcrum shaft 23 to the leading edge of the thin elastic member 21*a* is r2 (synonymous with Ld). In this case, in this embodiment, the position of the leading edge of the thin elastic member 21*a* is set such that the following Expression 2 is satisfied:

$$r1 > r2 \qquad \text{Expression (2)}$$

As long as Expression 2 is satisfied, a locus when the leading edge of the thin elastic member 21*a* is rotated about the axial line z does not exceed the top of the arc of the developing roller 17 and the thin elastic member 21*a* can reliably start to contact the developing roller 17 from the leading edge (edge) thereof.

Figure 5A:
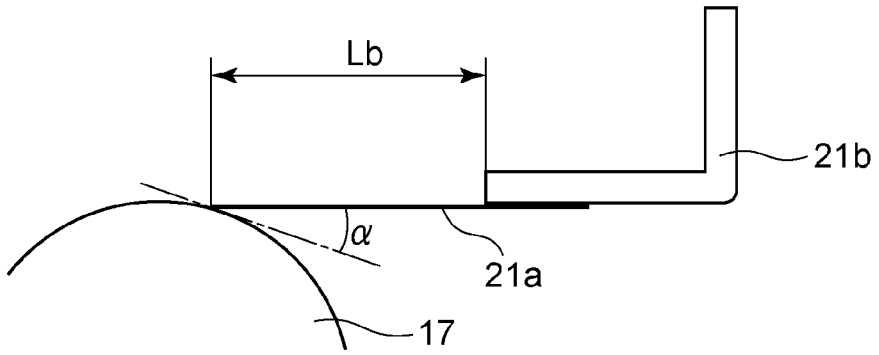
FIGS. 5A and 5B are schematic diagrams illustrating a set angle of the developing blade.
Figure 5B:
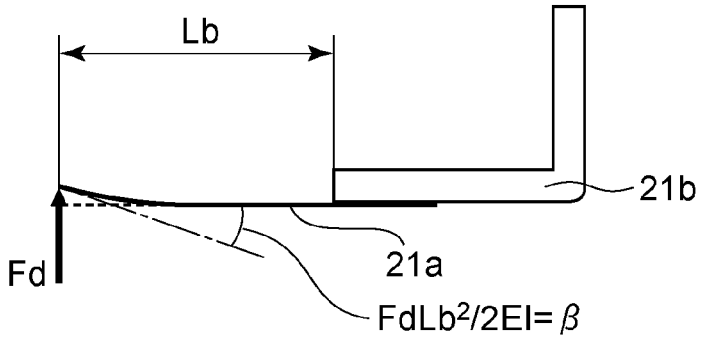

Next, the set angle of the developing blade 21 according to the disclosure will be described with reference to FIGS. 5A and 5B and FIG. 10. FIG. 5A shows a model in which no pressing force is applied to the developing blade 21 and FIG. 5B shows a model in which pressing force is applied to the developing blade 21.

Figure 10:
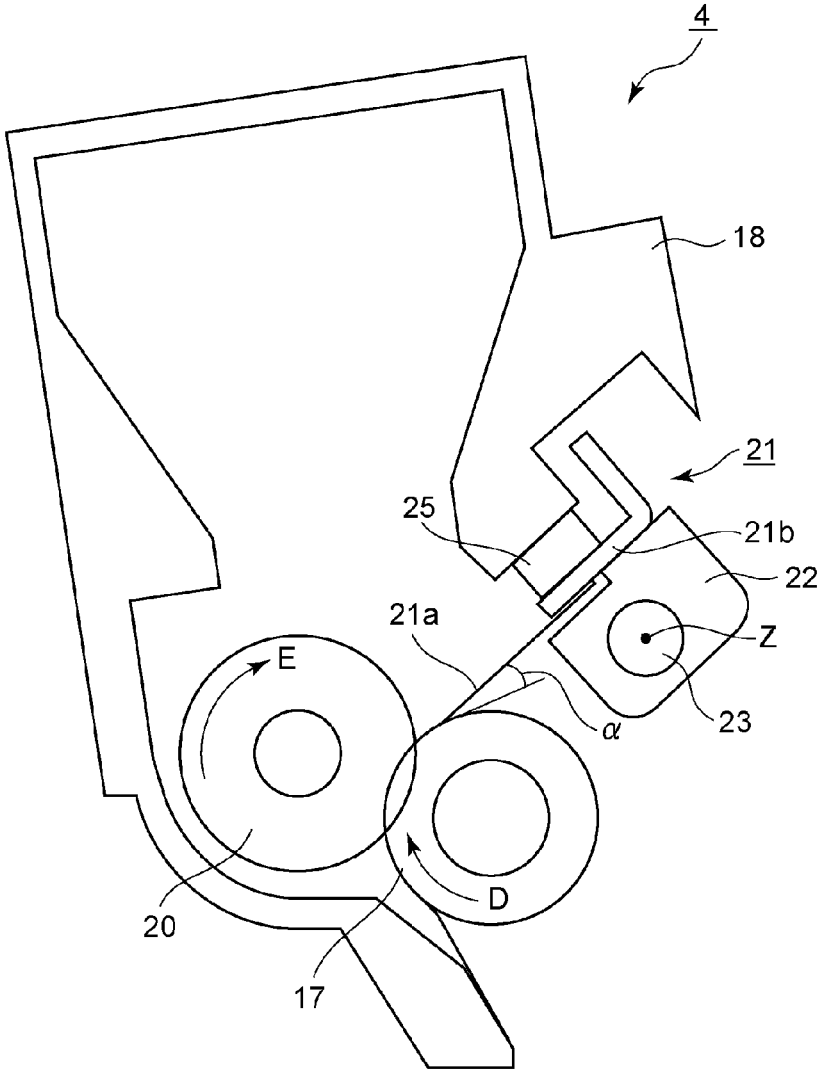
FIG. 10 is a schematic cross-sectional view of a process cartridge illustrating the set angle of the developing blade.

FIG. 10 is a diagram illustrating a case in which the pressurizing spring 24 urging the developing blade 21 is detached from the developing unit 4.

FIGS. 5A and 10 shows a no-load state in which the moment by the pressurizing spring 24 is not applied to the developing blade 21 and the developing blade 21 does not receive a load from the developing roller 17. In the no-load state, the angle formed between the developing blade 21 and a tangent line to the surface of the developing roller 17 at the contact point between the developing roller 17 and the developing blade 21 is a set angle α. The set angle α of the developing blade 21 is set so as to satisfy the following Expression 3.

$$\frac{FdLb^2}{2EI} < \alpha \qquad \text{Expression (3)}$$

Each symbol is defined as follows:

α: the set angle (rad);

Fd: the pressing force (N) of the developing roller 17 and the developing blade 21;

Lb: the free length of the thin elastic member 21*a*, that is, the distance from a cantilever fulcrum to the leading edge (m);

E: the Young's modulus of the thin elastic member 21*a* (Pa); and

I: the second moment of area of the thin elastic member 21*a* ($m^4$)

(where content in parentheses refers to a unit)

As shown in FIG. 5B, in the state in which the moment by the pressurizing spring 24 is not applied, the developing blade 21 receives a load from the contact portion with the developing roller 17. Therefore, the thin elastic member 21*a* that is supported by the supporting metal plate 21*b* in a cantilever manner is bent and the leading edge thereof is inclined by an angle (hereinafter, referred to as a "bending angle") β.

In general, the bending angle when a cantilever beam with the Young's modulus E, the free length L, and the second moment of area I receives a load P can be calculated as $PL^2/2EI$ by solving an elastic curve equation or by using Morh's theorem. In the equation, when P=Fd and L=Lb are substituted, the bending angle β of the thin elastic member 21*a* can be calculated as follows, as shown on the left side of Expression 3:

$$\beta(\text{rad}) = FdLb^2/2EI$$

That is, Expression 3 means that the set angle α of the developing blade 21 defined in the no-load state (the state in which the thin elastic member 21*a* does not receive a load from the developing roller 17) is more than the bending angle β formed when the thin elastic member 21*a* is bent.

Specifically, in this embodiment, in the no-load state, that is, in the state in which the moment by the pressurizing spring 24 is not applied to the developing blade 21, the set angle α is 13° (0.227 rad).

A steel plate with a thickness of 1.2 mm is used as the supporting metal plate. The thin elastic member 21*a* is a stainless steel plate with a thickness of 80 μm and the free length Lb of the thin elastic member 21*a* is 10 mm. In addition, the width of the thin elastic member 21*a* measured in the longitudinal direction of the developing roller 17 is 215 mm. The Young's modulus E of the stainless steel plate is 197000 MPa and the second moment of area of the thin elastic member 21*a* is $9.17\times10^{-15}$ $m^4$.

In this embodiment, the pressing force Fd generated between the developing roller 17 and the developing blade 21 is set to 5.0 N. This is applied to the left side of Expression 3. As a result, β=FdLb2/2EI=0.138 rad (7.93°) is obtained. The bending angle β is less than the set angle α(=13° (0.227 rad)) of the developing blade 21 in the no-load state. In this way, the thin elastic member 21*a* is bent to prevent a portion other than the leading edge of the thin elastic member 21*a*, that is, a ventral surface portion from contacting the developing roller 17. Therefore, it is possible to bring only the vicinity of the leading edge into contact with the developing roller 17.

$$\beta(\text{rad}) = FdLb^2/2EI = 0.138\text{rad}(7.93°)$$

Figure 6:
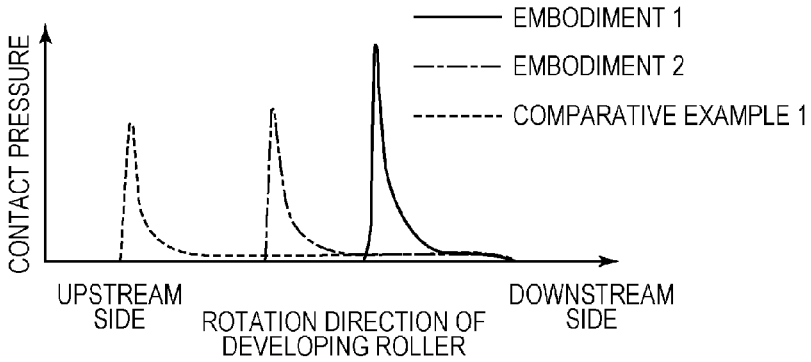
FIG. 6 is a graph illustrating a pressure distribution in a contact nip between a developing roller and the developing blade.

FIG. 6 shows a pressure distribution in a contact nip which is a contact region between the developing roller 17 and the developing blade 21. In Embodiment 1, since the deflection deformation of the thin elastic member 21*a* is prevented, the contact of the ventral surface portion of the thin elastic member 21*a* with the developing roller 17 is prevented. Therefore, in the pressure distribution according to Embodiment 1 which is represented by a solid line, the distance from the pressure peak at the leading edge of the thin elastic member 21*a* to the exit of the contact nip is short and it is possible to reduce a region with low contact pressure.

Figure 11:
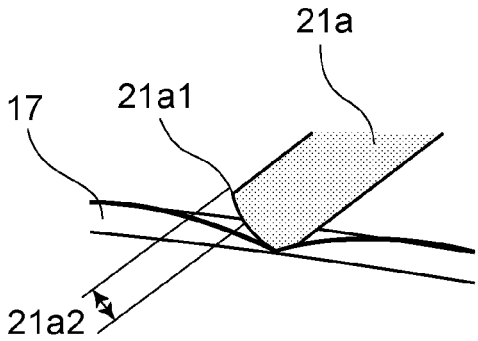
FIG. 11 is a schematic cross-sectional view of the developing device illustrating a shape of a leading edge of the developing blade.

It is preferable that the set angle α of the developing blade 21 in the no-load state be set to 30° or less. When the set angle α is set to be more than 30°, in some cases, vertical reinforcement occurs in the toner layer formed in the developing roller 17 during the regulation of toner on the developing roller 17 by the developing blade 21. It is considered that this is because a stripper plate (a plate formed in a punching process) is used as the thin elastic member 21*a*. That is, it is possible to stably manufacture the stripper plate. However, during the punching process, in some cases, a belly 21*a*1 is formed in a fracture surface 21*a*2 of the stripper plate, as shown in FIG. 11. In general, the direction of the thin elastic member 21*a* is determined such that the belly 21*a*1 faces in a direction opposite to the developing roller 17. If the set angle α of the developing blade 21 is set to 30° or more, the belly 21*a*1 is close to the developing roller 17 and is likely to affect the regulation of the toner layer. As a result, it is considered that vertical reinforcement occurs in the toner layer. When the set angle α is too large, in some cases, the leading edge of the thin elastic member 21*a* is bent back by the rotation of the developing roller 17. Therefore, in this embodiment, the set angle α is set to 30° or less on the basis of the above.

It is preferable that the thin elastic member 21*a* be made of a material with a Young's modulus of 68000 MPa or more in order to stabilize the degree of bending deformation (the magnitude of the bending angle) of the thin elastic member 21*a* with respect to the pressing force Fd generated between the developing roller 17 and the developing blade 21. That is, it is preferable that the thin elastic member 21*a* be made of a metal material. Therefore, in this embodiment, a stainless steel plate is used as the thin elastic member 21*a*. However, the thin elastic member 21*a* may be made of other materials, such as phosphor bronze and aluminum. The metal material described in this embodiment includes alloys.

<Embodiment 2>

Next, another embodiment will be described. A toner regulation member according to this embodiment is basically based on Embodiment 1. However, this embodiment differs from Embodiment 1 in that, in a no-load state, that is, in a state in which the moment by the pressurizing spring 24 is not applied, the set angle α of the developing blade 21 is set to 8° which is less than that in Embodiment 1. The bending angle of the thin elastic member 21*a* applied to the left side of Expression 3 is 7.93° (0.138 rad) which is equal to that in Embodiment 1. In this embodiment, the set angle α of the developing blade 21 is slightly more than the bending angle.

When a pressure distribution according to this embodiment is compared with that according to Embodiment 1, as represented by a one-dot chain line in FIG. 6, a region with low contact pressure is wide. It is considered that this is because the set angle α of the developing blade 21 defined in the no-load state is slightly more than the bending angle. That is, when the thin elastic member 21*a* is bent, a ventral surface portion of the thin elastic member 21*a* starts to contact the developing roller 17 due to the deformation of the developing roller 17.

<Comparative Example>

Figure 14:
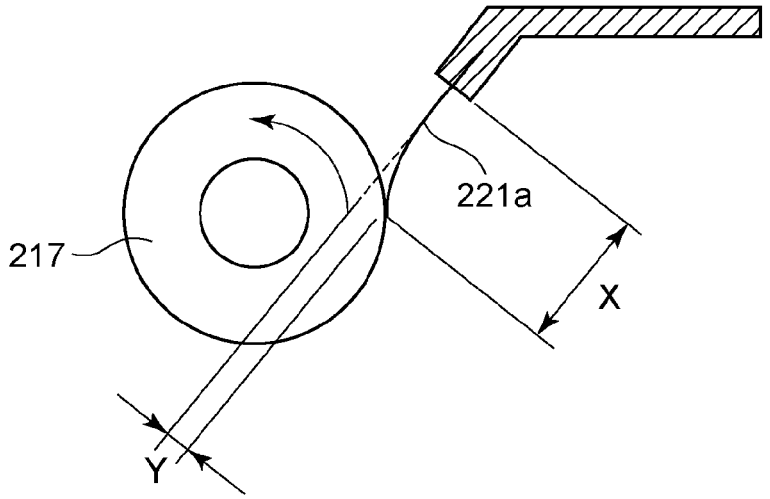
FIG. 14 is a schematic cross-sectional view illustrating a developing regulation member according to the related art.
Figure 15:
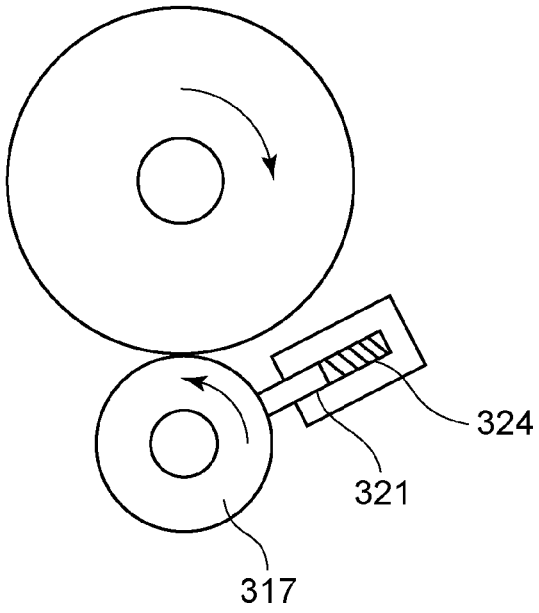
FIG. 15 is a schematic cross-sectional view illustrating the developing regulation member according to the related art.
Figure 16:
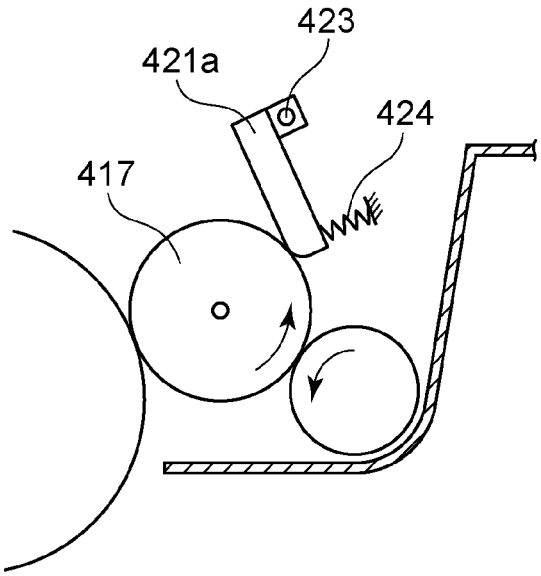
FIG. 16 is a schematic cross-sectional view illustrating the developing regulation member according to the related art.

Next, a comparative example for confirming the effects of Embodiment 1 and Embodiment 2 will be described. A toner regulation member according to this comparative example will be described with reference to FIG. 14. In a developing blade serving as the toner regulation member according to this comparative example, a thin elastic member 221*a*, such as a phosphor-bronze plate or a stainless steel plate, is supported in a cantilever manner by a supporting metal plate fixed to a developing container and the free end of an opposing portion comes into contact with a developing roller 217.

In this comparative example, in a no-load state, that is, in a state in which a developing roller is not pressed into the thin elastic member 221*a*, the set angle α of the developing blade is 8°. In addition, a steel plate with a thickness of 1.2 mm is used as the supporting metal, the thin elastic member is a stainless steel plate with a thickness of 80 μm, and the free length Lb of the thin elastic member 21*a* is 10 mm. The Young's modulus E of the stainless steel plate is 197000 MPa and the second moment of area of the thin elastic member 21*a* is $9.17\times10^{-15}$ $m^4$.

In this comparative example, in a state in which the developing roller is pressed into the thin elastic member by a predetermined depth, the thin elastic member 221*a* can be bent and deformed to ensure contact pressure. The depth of the developing roller pressed into the thin elastic member 221*a* is 1.2 mm.

In this comparative example, in a state in which the developing roller is pressed into the thin elastic member 221*a*, the bending angle of the thin elastic member 221*a* in the contact portion between the thin elastic member 221*a* and the developing roller is 10.31° which is more than the set angle, 8°, of the developing blade. Therefore, for the contact state between the thin elastic member 221*a* and the developing roller in Comparative Example 1, the leading edge of the thin elastic member and the ventral surface of the thin elastic member other than the leading edge come into contact with the developing roller at the same time.

In a pressure distribution according to this comparative example, as represented by a dotted line in FIG. 6, a region with low contact pressure is wider than those in Embodiment 1 and Embodiment 2.

The pressing force Fd applied from the developing roller 17 to the developing blade 21 in Embodiment 1 and Embodiment 2 and the depth of the developing roller pressed into the thin elastic member in Comparative Example 1 were set under each condition such that the same amount of toner is coated on the developing roller.

(Evaluation Method of Each Embodiment and Comparative Example)

The structure of the embodiments of the disclosure was evaluated as follows.

(1) Line Image Evaluation

Image evaluation was performed by printing a solid black image on the entire surface of a recording sheet, outputting the recording sheet, and visually checking whether there is a vertical streak extending in a direction perpendicular to the longitudinal direction (laser main scanning direction).

The line image evaluation for the solid image was performed after an image forming apparatus was placed in an evaluation environment of a temperature of 15.0° C. and a relative humidity of 10% Rh for a day to be accustomed to the environment and a print test was performed for 5000 recording sheets. In the print test, a recording image that includes a plurality of horizontal lines (lines along the axial line direction of the photosensitive drum) and has an image percentage of 5% is printed on the recording sheet which continuously passes. The test result is shown in the following Table 1. The evaluation symbols ○, Δ, and x used in the line image evaluation fields are defined as follows:

○: One or no line image is recognized;

Δ: The number of recognized line images is equal to or more than 2 and less than 5; and X: Five or more line images are recognized.

(2) Image Density Evaluation for Assembly Error

The position of the developing blade was moved ±0.1 mm, that is, in the range of 0.2 mm from a reference position in a direction perpendicular to the plane of the thin elastic member, considering the assembly error of the developing blade, and image density was evaluated. When the developing blade was arranged at a set position of +0.1 mm and a set position of −0.1 mm, a solid black image was output and density was measured using Spectrodensitometer 500 manufactured by X-Rite, Incorporated. A monochrome print test and evaluation image is output. In the following Table 1, evaluation symbols ○ and x used in a field "Image density evaluation for assembly error" are defined as follows:

○: The density difference is less than 0.2 in the position set range of the developing blade in the solid black image; and x: The density difference is equal to or more than 0.2 in the position set range of the developing blade in the solid black image.

The image density evaluation for the solid black image was performed after the image forming apparatus was placed in an evaluation environment (25.0° C. and 50% Rh) for a day to be accustomed to the evaluation environment and the print test was performed for 100 recording sheets. In the print test, a recording image that includes a plurality of horizontal lines and has an image percentage of 5% is printed on the recording sheet which continuously passes.

(3) Endurance of Developing Blade

When the endurance of the developing blade was evaluated, first, the image forming apparatus was placed in an evaluation environment (25.0° C. and 50% Rh), the print test was performed for 10000 recording sheets, and the developing blade was detached and then attached to a new developing unit. Then, solid black images were output using a developing unit using a new developing blade and the developing unit using the used (after the print test was performed for 1000 recording sheets) developing blade and density was measured by Spectrodensitometer 500 manufactured by X-Rite, Incorporated. A monochrome print test and evaluation image is output. In the following Table 1, evaluation symbols ○ and x used in a field "Recyclability of developing blade" are defined as follows:

○: The density difference of the solid black image when the used developing blade is used and when a new developing blade is used is less than 0.2; and X: The density difference of the solid black image when the used developing blade is used and when a new developing blade is used is equal to or more than 0.2.

When the developing unit using a new developing blade was used to form a solid black image, the image forming apparatus was placed in the evaluation environment (25.0° C. and 50% Rh) for a day to be accustomed to the environment in advance and the print test was performed for 100 recording sheets. In the print test, a recording image that includes a plurality of horizontal lines and has an image percentage of 5% is printed on the recording sheet which continuously passes.

[Evaluation Results of Embodiments 1 and 2 and Comparative Example 1]

Table 1 shows the evaluation results when the evaluation method is applied to Embodiments 1 and 2 and Comparative Example 1.

TABLE 1

| | Line image evaluation | Image density evaluation for assembly error | Endurance evaluation for developing blade |
|---|---|---|---|
| Embodiment 1 | ○ | ○ | ○ |
| Embodiment 2 | Δ | ○ | ○ |
| Comparative Example 1 | X | X | X |

(Superiority over Related Art)

The superiority of the concepts disclosed herein over the related art will be described.

First, line image evaluation will be described. After the print test for 5000 recording sheets, few line images were generated in Embodiment 1 and it was possible to suppress the generation of line images in Embodiment 2. However, in Comparative Example 1, line images were generated after the print test.

FIG. 6 shows a pressure distribution in a contact nip which is a contact region between the developing roller and the developing blade. A solid line indicates Embodiment 1, a one-dot chain line indicates Embodiment 2, and a dotted line indicates Comparative Example 1. The downstream side of the contact nip portion in the rotation direction of the developing roller is shown. The common point to all conditions is that, since the leading edge of the thin elastic member contacts, there is the peak of contact pressure at the leading edge and a region with low contact pressure is formed on the downstream side of the nip portion in the rotation direction of the developing roller.

However, in Comparative Example 1, a region with low contact pressure is wider than that in Embodiment 1 and Embodiment 2. The reason is as follows. A predetermined amount of bending is set to the thin elastic member which is a leaf spring and is supported in a cantilever manner and the thin elastic member is fixed to the developing container to ensure contact pressure. Therefore, in this structure, a ventral surface portion of the thin elastic member other than the leading edge also comes into contact with the developing roller. However, toner or an external toner additive tends to stay in the region with low contact pressure. In addition, when the region with low contact pressure is wide, it is difficult to remove the toner attached to the developing blade. As a result, the melt-adhesion of the developing blade occurs on the downstream side of the contact nip portion between the developing roller and the developing blade in the rotation direction of the developing roller.

In practice, in the line image evaluation, when the developing blade according to Comparative Example 1 was observed, a fused material is attached in correspondence with the line image. In addition, an aspect of the generation of melt-adhesion was examined. The examination result proved that a fused material was generated from the downstream side of the contact portion between the developing blade and the developing roller in the rotation direction of the developing roller and was grown to the upstream side.

In contrast, in Embodiment 1, it was possible to suppress the generation of the line image after the print test. In addition, the developing blade according to Embodiment 1 was observed and no fused material was generated. It is considered that this is because the set angle $\alpha$ of the developing blade 21 defined in the no-load state is set to be more than the bending angle $\beta$ formed by the bending deformation of the thin elastic member 21*a* in Embodiment 1. That is, it is considered that, even when the thin elastic member 21*a* is bent, the contact between the ventral surface portion of the thin elastic member 21*a* and the developing roller 17 can be prevented.

In this embodiment, the rubber material (elastic layer) forming the developing roller 17 is softer than that forming the thin elastic member 21*a*. Therefore, the developing roller 17 is deformed by the contact between the thin elastic member 21*a* and the developing roller 17 and a little contact nip (contact region) is formed between the thin elastic member 21*a* and the developing roller 17. However, the bending angle β can be set to be less than the set angle α to reduce the range of the contact nip. As a result, as represented by the solid line in FIG. 6, the distance from the pressure peak at the leading edge to the exit of the contact nip is short and it is possible to reduce the region with low contact pressure. Since the region with low contact pressure is reduced, it is possible to prevent toner or an external toner additive from staying and thus prevent the generation of a fused material in the developing blade.

In Embodiment 2, when image evaluation was performed after the print test for 5000 recording sheets, a few line images were observed, but it was possible to reduce the number of line images generated, as compared to Comparative Example 1.

In Embodiment 2, the set angle α of the developing blade 21 defined in the no-load state is set to be slightly more than the bending angle $\beta = FdLb^2/2EI$. Therefore, when the thin elastic member 21*a* is bent, the ventral surface portion of the thin elastic member 21*a* starts to contact the developing roller 17 due to the deformation of the developing roller 17, and the region with low contact pressure is wider than that in Embodiment 1. As a result, it is considered that the effect of preventing toner or an external toner additive from staying in Embodiment 2 is less than that in Embodiment 1. In practice, when the developing blade 21 according to Embodiment 2 was observed, a very small amount of fused material was attached. The amount of fused material is as small as the fused material can be removed by air-blowing.

As described above, in Embodiments 1 and 2, it was possible to reduce the region with low contact pressure between the thin elastic member 21*a* and the developing roller 17. In this way, it is possible to prevent toner or an external toner additive from staying and thus prevent the generation of a fused material in the developing blade 21.

In this embodiment, since the position of the leading edge of the thin elastic member 21*a* is set so as to satisfy the above-mentioned Expression 2, the thin elastic member 21*a* can reliably start to contact the developing roller 17 from the leading edge thereof. In addition, even in the state in which the moment by the pressurizing spring 24 is applied, the contact of the ventral surface portion of the thin elastic member 21*a* with the developing roller 17 is prevented. Therefore, it is possible to stabilize the contact of the leading edge of the developing blade 21 with the developing roller 17. As a result, it is possible to prevent the melt-adhesion of the developing blade on the upstream side of the contact nip portion between the developing roller 17 and the developing blade 21 in the rotation direction of the developing roller.

Next, image density evaluation for an assembly error will be described.

In Embodiment 1 and Embodiment 2, a density variation in the set range of the position of the developing blade is prevented. In contrast, in Comparative Example 1, a density variation occurs in the set range of the position of the developing blade.

Figure 7:
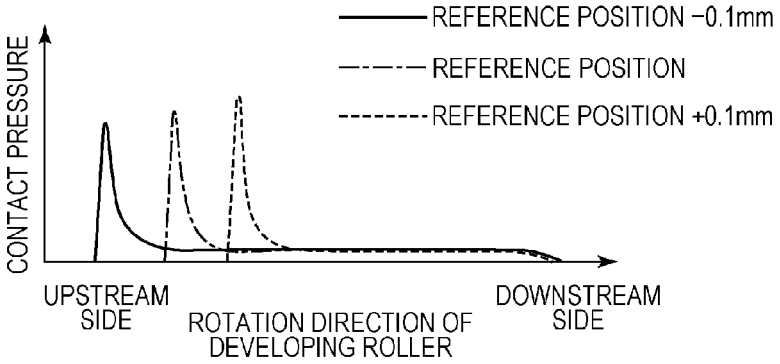
FIG. 7 is a graph illustrating a pressure distribution in a contact nip between a developing roller and a developing blade, for the setting of the position of the developing blade according to Comparative Example 1.

In Comparative Example 1, a predetermined amount of bending is set to the thin elastic member which is a leaf spring and is supported in a cantilever manner and the thin elastic member is fixed to the developing container to ensure contact pressure. Therefore, when the setting of the position of the developing blade is changed in a direction perpendicular to the plane of the thin elastic member, the amount of bending is changed, which results in a large variation in contact pressure. FIG. 7 shows a pressure distribution in a contact nip, which is a contact region between the developing roller and the developing blade, for the setting of the position of the developing blade in Comparative Example 1.

As shown in FIG. 7, when the developing blade inroad amount to the developing roller increases, a region with low contact pressure, which is a ventral surface portion, is widened and the contact pressure of the leading edge is reduced. That is, as the state of the thin elastic member, the amount of deformation of the thin elastic member increases and the contact ratio of the ventral surface with the developing roller increases. As a result, the leading edge rises up. This tends to occurs in the structure in which the ventral surface and the leading edge of the thin elastic member come into contact with the developing roller at the same time, as in Comparative Example 1.

On the other hand, in Embodiment 1 and Embodiment 2, even when the setting of the position of the developing blade 21 is changed in the direction perpendicular to the plane of the thin elastic member, the developing blade 21 rotates about the pivotal movement fulcrum shaft 23 and the leading edge of the developing blade 21 comes into contact with the developing roller 17. From the time when the developing blade 21 comes into contact with the developing roller 17, a load is applied from the developing blade 21 to the developing roller 17 by the force of the pressurizing spring 24 urging the developing blade 21. When the position of the developing blade 21 is changed, a little variation occurs in the compressed state of the pressurizing spring 24. However, the spring constant of the pressurizing spring 24 can be appropriately set in advance to prevent a variation in the contact pressure between the developing blade 21 and the developing roller 17. That is, it is possible to prevent a variation in the deformed state of the thin elastic member 21*a* with respect to a variation in the setting of the position of the developing blade 21 and stabilize the contact between the developing blade 21 and the developing roller 17. As a result, it is possible to prevent a density variation due to an error in the arrangement of the developing blade 21.

Next, the evaluation of the endurance of the developing blade will be described.

Figure 8:
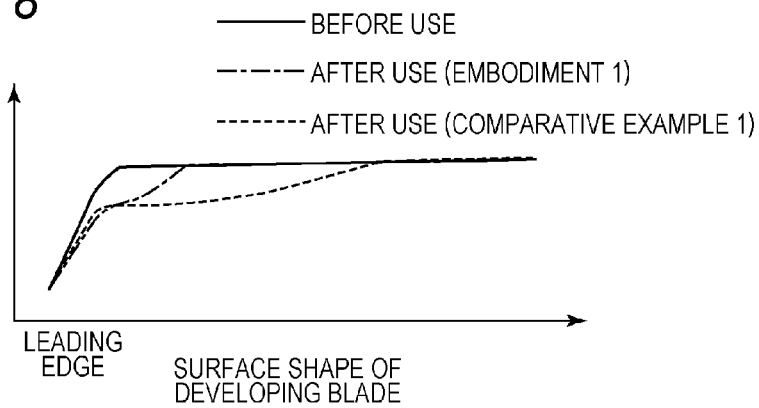
FIG. 8 is a schematic diagram illustrating a shape profile of a thin elastic member.

FIG. 8 shows the shape of the thin elastic member in Embodiment 1 and Comparative Example 1, in which a solid line indicates a shape profile before use, a one-dot chain line indicates the shape after use in Embodiment 1, and a dotted line indicates the shape after use in Comparative Example 1. A laser scanning confocal microscope (VK-9500 manufactured by Keyence Corporation) is used to acquire the shape.

In the embodiments of the disclosure and the comparative example, a stainless steel plate with high endurance is used as the thin elastic member. However, when the shape of the thin elastic member 21*a* is observed after the thin elastic member 21*a* is used for a long time, as shown in FIG. 8, the contact portion is likely to be slightly scraped in both the embodiments and the comparative example. The degree of scraping is several micrometers. In particular, the amount of scraping at the leading edge with high contact pressure is relatively large. It is considered that the scraping occurs since the thin elastic member 21*a* is slightly scraped by hard particles, such as silica particles which are added to the toner from the outside.

In the evaluation, the print test was performed for 10000 recording sheets and the developing blade with the scraped leading edge was detached and then attached to a new developing unit. In Embodiment 1 and Embodiment 2, it was possible to prevent a density difference in the images formed when the developing blade which had used in the print test for 10000 recording sheets was used and when a new developing blade was used. In contrast, in Comparative Example 1, it was difficult to prevent the density difference in the images formed when the developing blade which had used in the print test was used and when the new developing blade was used.

Figure 9A:
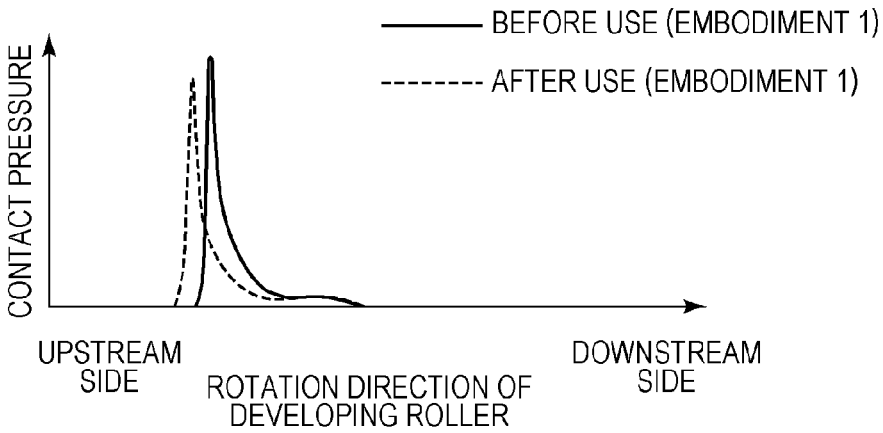
FIGS. 9A and 9B are graphs illustrating a pressure distribution in the contact nip between the developing roller and the developing blade before and after the developing blade is used.
Figure 9B:
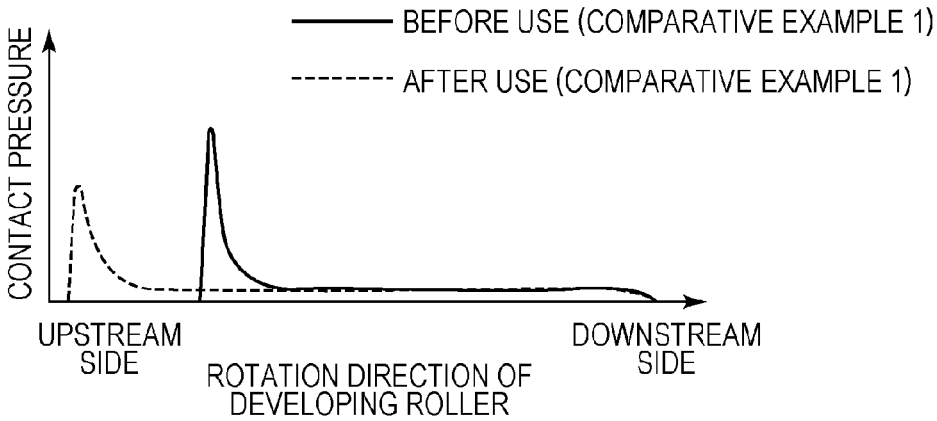

FIGS. 9A and 9B show pressure distributions in the contact nip, which is the contact region between the developing roller and the developing blade, in Embodiment 1 and Comparative Example 1. FIGS. 9A and 9B show the pressure distributions after the developing blade is used in the print test and before the developing blade is used in the print test. A solid line shows the pressure distribution in the new developing blade before the print test and a dotted line indicates the pressure distribution in the developing blade which is scraped after the print test. The downstream side of the contact nip portion in the rotation direction of the developing roller is shown.

In Comparative Example 1, in the pressure distribution in the developing blade before use, a region with low contact pressure, which is a ventral surface portion, is wide and the contact pressure of the leading edge is low. In Comparative Example 1, the developing blade is fixed to the developing container and the leading edge and the ventral surface of the thin elastic member come into contact with the developing roller at the same time. In this case, since the ventral surface portion receives contact pressure, it is difficult to actively bring the scraped leading edge into contact with the developing roller in structure. As a result, the contact pressure of the leading edge is reduced.

On the other hand, in Embodiment 1, a reduction in the contact pressure at the leading edge is less than that in Comparative Example 1. Since Embodiment 1 is configured so as to satisfy the above-mentioned Expression 2, the thin elastic member 21*a* can reliably start to contact the developing roller 17 from the leading edge thereof. The contact of the ventral surface portion of the thin elastic member 21*a* with the developing roller 17 is prevented. Therefore, even when the leading edge is scraped, it is possible to actively bring a new leading edge which is generated by the scraping into contact with the developing roller. As a result, it is possible to prevent a reduction in contact pressure at the leading edge.

As described above, in the embodiment disclosed herein, it is possible to prevent the density difference between the scraped developing blade after use and a new developing blade before use and the endurance of the developing blade is high. In this way, it is possible to use the developing unit for a long time or reuse (recycle) the used developing blade.

However, in the developing blade with the structure according to Comparative Example 1, when the depth of the developing blade pressed into the developing roller is set to a small value to reduce the amount of bending, it is possible to form the same pressure distribution as that in the embodiment disclosed herein. However, in the structure according to Comparative Example 1, when the amount of bending of the developing blade is reduced, the pressure distribution for the developing roller is likely to be greatly changed due to, for example, a variation (error) in the radius of the developing roller, the depression of the developing roller, and the assembly tolerance of the developing unit. Therefore, it is difficult to actually use the setting.

In contrast, in Embodiments 1 and 2, even when the radius of the developing roller 17 varies, the developing roller 17 is recessed, or the assembly tolerance of the developing unit 4 varies, the developing blade 21 is rotated about the pivotal movement fulcrum shaft 23 and reliably contacts the developing roller. An appropriate load is applied from the developing blade 21 to the developing roller 17 by the pressurizing spring 24. That is, a predetermined amount of bending is not set to the thin elastic member 21*a* to ensure a contact load, but the load is set by the pressurizing spring 24. Therefore, it is possible to stably use the thin elastic member 21*a* even in a state in which the amount of bending of the thin elastic member 21*a* is small.

The pressure distribution in the contact nip, which is the contact region between the developing roller and the developing blade is the result obtained by simulations using a finite element method. Here, general-purpose finite element method software "ABAQUS" manufactured by Dassault Systemes Simulia Corp. was used. In addition, the conditions described in the embodiments and the comparative example are applied.

[Conclusion]

As described above, in this embodiment, the developing blade 21 serving as a developer regulating member is attached to the developing frame 18 so as to be rotatable about the axial line z of the pivotal movement fulcrum shaft 23. The developing blade 21 is urged by the pressurizing spring 24 which is an urging portion. In this way, it is possible to press the developing roller 17 with predetermined pressing force suitable to form an image, using the force of the pressurizing spring 24. In addition, even when the position of the developing blade 21 is changed or even when the developing blade 21 is used for a long time, it is possible to maintain a variation in the pressing force of the developing blade 21 against the developing roller 17 to be small.

In particular, in this embodiment, the free length of the developing blade 21 is less than the distance from the axial line z of the pivotal movement fulcrum shaft to the center of the developing roller 17 and the bending angle β in the state in which the developing blade 21 is bent is defined to be less than the set angle α of the developing blade 21. That is, for example, the structure and arrangement of the developing blade 21 or the pressurizing spring 24 is defined such that the load applied to the developing blade 21 due to contact with the developing roller 17, and the Young's modulus and the second moment of area of the developing blade 21 satisfy the following Expression 3a.

$$\beta = \frac{FdLb^2}{2EI} < \alpha \qquad \text{Expression (3a)}$$

As a result, even when the thin elastic member 21*a* of the developing blade 21 contacts the developing roller 17 and is then bent, a portion of the thin elastic member 21*a* other than the leading edge is less likely to contact the developing roller 17 and the contact area between the thin elastic member 21*a* and the developing roller 17 is reduced. That is, the peak value of pressure applied from the developing blade 21 to the developing roller 17 increases and the contact region of the developing blade 21 with the developing roller 17 is reduced even at low pressure. Therefore, it is easy for the developing blade 21 to regulate the amount of developer held by the developing roller 17 to a predetermined amount.

[Modification]

Figure 12:
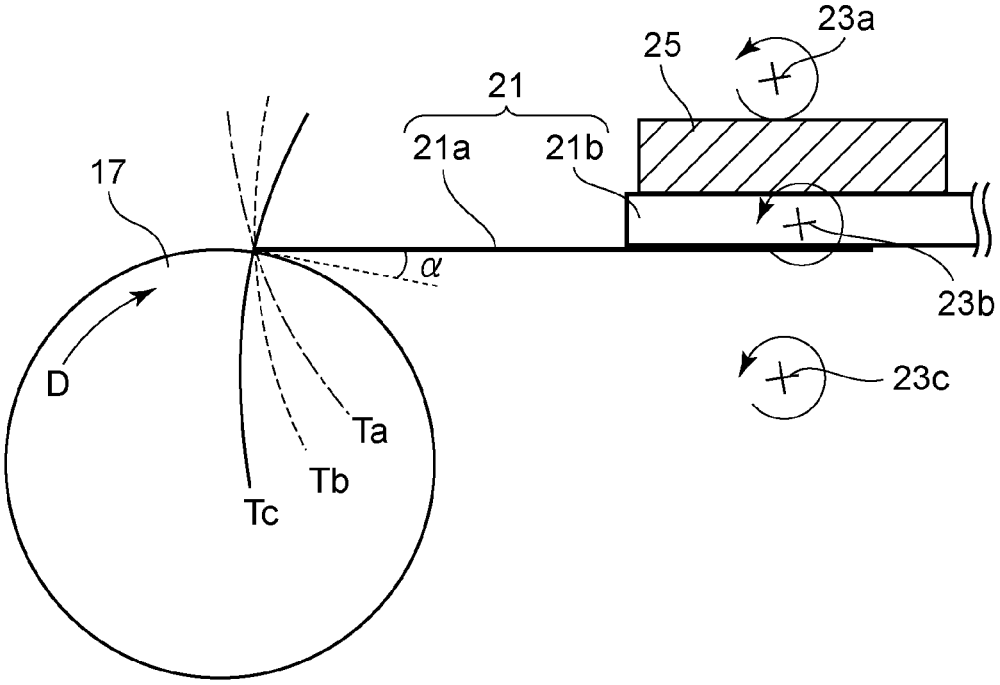
FIG. 12 is a schematic cross-sectional view of the developing device illustrating a position of a pivotal movement fulcrum shaft.

Next, a modification of Embodiments 1 and 2 will be described with reference to FIG. 12. In the modification, the arrangement of the pivotal movement fulcrum shaft 23 is different from that in Embodiments 1 and 2. FIG. 12 schematically shows the cross-section of the developing unit and is a cross-sectional view taken along the line perpendicular to the axial line of the developing roller 17.

In Embodiments 1 and 2, the center of the developing roller 17 and the pivotal movement fulcrum shaft 23 are arranged below the developing blade 21 (see FIG. 4). That is, in Embodiments 1 and 2, the pivotal movement fulcrum shaft 23 is provided at a position 23*c*, which means that the center of the developing roller 17 and the pivotal movement fulcrum shaft 23 are disposed at the same side of the thin elastic member 21*a*.

However, the arrangement of the developing roller and the pivotal movement fulcrum shaft 23 is not necessarily limited to that according to Embodiments 1 and 2. As a modification of Embodiments 1 and 2, the pivotal movement fulcrum shaft 23 may be provided at a position 23*a* opposite to the center of the developing roller 17 with respect to the developing blade 21. The pivotal movement fulcrum shaft 23 may be provided at a position (position 23*b*) where it overlaps the supporting metal plate 21*b* of the developing blade 21 in the cross-section shown in FIG. 12.

However, in the case in which the position of the pivotal movement fulcrum shaft 23 is different, when the developing blade 21 is pressed into the developing roller 17, a change in the angle of the developing blade 21 with respect to the developing roller 17 varies, which will be described below.

Since the developing roller 17 includes an elastic layer, in some cases, the leading edge of the thin elastic member 21*a* is pressed into the developing roller 17 and the angle of the thin elastic member 21*a* with respect to the developing roller 17 is changed from the set angle α (see FIG. 11). In this case, as shown in FIG. 12, when the pivotal movement fulcrum shaft 23 is disposed at the positions 23*a*, 23*b*, and 23*c*, the movement loci of the leading edge of the thin elastic member 21*a* are Ta, Tb, and Tc. That is, the movement locus of the thin elastic member 21*a* varies depending on the position of the pivotal movement fulcrum shaft 23. Therefore, a change in the angle of the thin elastic member 21*a* also varies.

When the thin elastic member 21*a* is pressed into the elastic layer of the developing roller 17, the angle of the thin elastic member 21*a* with respect to the developing roller 17 is more than the set angle α. In this case, as can be seen from FIG. 12, when the pivotal movement fulcrum shaft 23 is provided at the position 23*a*, the angle of the thin elastic member 21*a* with respect to the developing roller 17 is likely to be more than that when the pivotal movement fulcrum shaft 23 is provided at the positions 23*b* and 23*c*.

That is, in the case in which the pivotal movement fulcrum shaft 23 is provided at the position 23*a*, when the thin elastic member 21*a* is pressed into the developing roller 17, it is easy to maintain the inclination of the thin elastic member 21*a* with respect to the developing roller 17 to be more than the bending angle β of the thin elastic member 21*a*.

However, when the angle of the thin elastic member 21*a* of the developing roller 17 is significantly more than the set angle α, as described above, the belly 21*a*1 (see FIG. 11) of the thin elastic member 21*a* is likely to affect the regulation of toner. In addition, the leading edge of the thin elastic member 21*a* is likely to be bent back by the rotation of the developing roller 17. Therefore, when the pivotal movement fulcrum shaft 23 is provided at the position 23*a*, it is necessary to set a sufficient allowance between the set angle α and the upper limit.

On the other hand, in the case in which the pivotal movement fulcrum shaft 23 is provided at the position 23*b*, even when the thin elastic member 21*a* is pressed into the developing roller 17, the angle of the thin elastic member 21*a* with respect to the developing roller 17 is less likely to be more than the set angle α. That is, it is possible to prevent the belly 21*a*1 (see FIG. 11) of the thin elastic member 21*a* from affecting the regulation of toner or prevent the thin elastic member 21*a* from being bent back.

In a case in which the set angle α can be set to be sufficiently more than the "bending angle β", which is the lower limit, when the thin elastic member 21*a* is pressed into the developing roller 17, it is preferable that the angle of the thin elastic member 21*a* with respect to the developing roller 17 not be large. That is, in this case, it is preferable that the pivotal movement fulcrum shaft 23 be provided at the position 23*b* or the position 23*c* as in Embodiments 1 and 2.

As described in the modification, when the pivotal movement fulcrum shaft 23 is provided at the position 23*b*, the pivotal movement fulcrum shaft 23 can be directly attached to the supporting metal plate. Therefore, the pivotal movement frame 22 (see FIG. 4) used in Embodiment 1 is not needed. It is possible to reduce the size of the developing device by a value corresponding to the space of the pivotal movement frame 22.

When the pivotal movement fulcrum shaft 23 is provided at the position 23*c*, the angle of the thin elastic member 21*a* with respect to the developing roller 17 is less likely to increase, as compared to when the pivotal movement fulcrum shaft 23 is provided at the position 23*b*. That is, it is most preferable to provide the pivotal movement fulcrum shaft 23 at the position 23*c* in order to reduce the influence of the belly 21*a*1 or prevent the thin elastic member 21*a* from being bent back.

<Embodiment 3>

Figure 13:
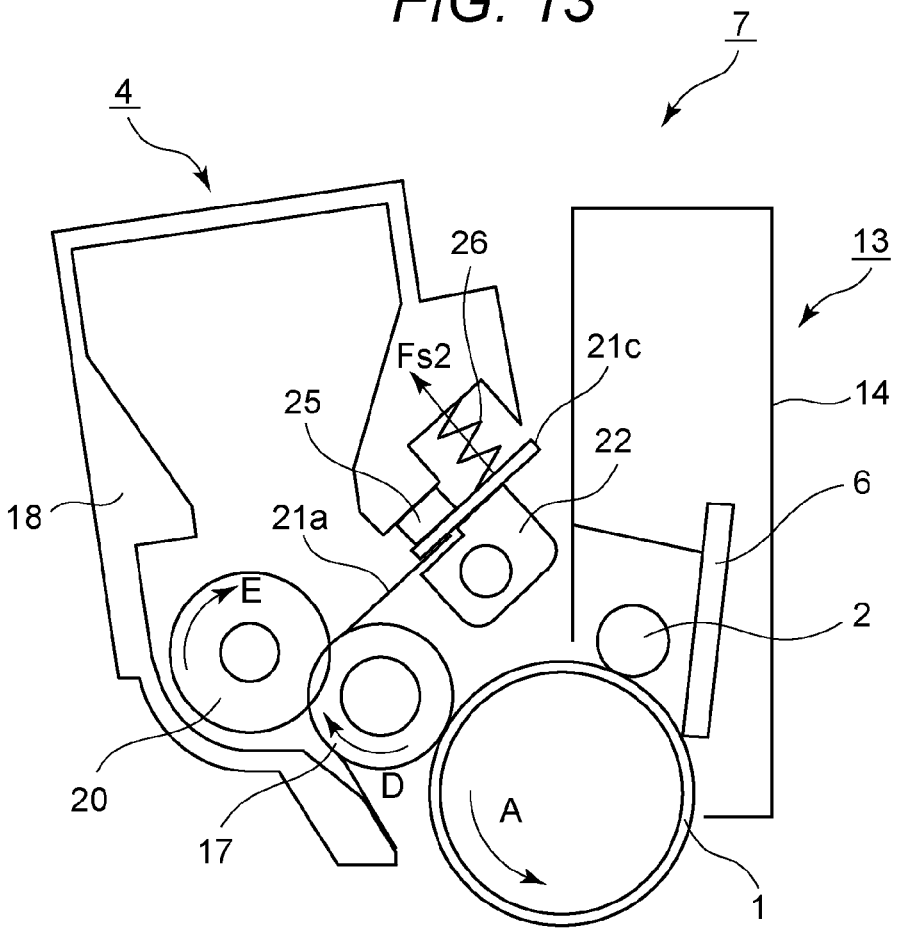
FIG. 13 is a schematic cross-sectional view illustrating a process cartridge according to Embodiment 3.

Another embodiment of the application will be described with reference to FIG. 13. This embodiment is characterized in that an extension spring 26 is used as an urging portion for urging a developing blade 21, unlike the above-described embodiments. In the following description, members having the same functions and structures as those in Embodiments 1 and 2 are denoted by the same reference numerals and the detailed description thereof will not be repeated.

In this embodiment, a supporting metal plate 21*c* which supports a thin elastic member 21*a* is provided in the developing blade 21. The supporting metal plate 21*c* is not bent, unlike the supporting metal plate 21*b* used in the above-described embodiments. The extension spring 26 is attached to the supporting metal plate 21*c*.

The extension spring 26 draws the supporting metal plate 21*c* to apply force Fs2 to the developing blade 21. As a result, moment in the counterclockwise direction is applied to the developing blade 21 and the thin elastic member 21*a* is pressed to the developing roller 17. In this case, this embodiment is configured so as to satisfy the above-mentioned Expression 3a. Therefore, the bending angle β of the thin elastic member 21*a* is less than a set angle α. Only the leading edge of the thin elastic member 21*a* can contact the developing roller 17.

According to the invention, it is possible to prevent the generation of a fused material in a developer regulating member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-123497, filed May 30, 2012, which is hereby incorporated by reference herein in its entirety.

What is claimed is:

1. A developing device used in an image forming apparatus, comprising:

a developer carrying member that carries a developer to develop an electrostatic latent image formed on an image carrying member;

a developer regulating member that includes a plate-shaped elastic member, is rotatably supported, and brings the elastic member into contact with the developer carrying member such that a leading edge of the elastic member faces an upstream side, in a rotation direction, of the developer carrying member to regulate a amount of developer held in the developer carrying member; and an urging portion that applies a moment to the developer regulating member to bring the developer regulating member into pressure contact with the developer carrying member, wherein a distance from a rotation center of the developer regulating member to a center of the developer carrying member is set to be more than a distance from the rotation center of the developer regulating member to the leading edge of the elastic member, and when a load received by the developer regulating member due to contact between the developer carrying member is P (N), a free length of the developer regulating member is L (m), a Young's modulus of the developer regulating member is E (Pa), a second moment of area of the developer regulating member is I ($m^4$), and an angle formed between the elastic member and a tangent line to the developer carrying member in a contact portion between the leading edge of the developer regulating member and the developer regulating member at a time when the elastic member comes into contact with the developer carrying member without receiving the load is a set angle α (rad), a bending angle β of the elastic member calculated from the following Expression 1 is less than the set angle α:

$$\beta = PL^2/2EI.$$

2. The developing device according to claim 1, wherein the elastic member is made of a metal material.

3. The developing device according to claim 1, wherein the developer regulating member includes a supporting member that supports the elastic member, and the urging portion applies an urging force to the supporting member.

4. The developing device according to claim 3, wherein the supporting member is a bent metal plate and includes a first surface to which the elastic member is fixed and a second surface which intersects the first surface and receives the urging force from the urging portion.

5. The developing device according to claim 1, wherein the urging unit applies an urging force to the developer regulating member in a direction in which the elastic member extends to the developer carrying member.

6. The developing device according to claim 1, wherein the rotation center of the developer regulating member and the rotation center of the developer carrying member are disposed on a same side of the elastic member.

7. The developing device according to claim 1, wherein the developer regulating member includes a supporting member that supports the elastic member, and the rotation center of the developer regulating member is arranged at a position to overlap the supporting member in a plane perpendicular to an axial line of the developer carrying member.

8. The developing device according to claim 1, wherein the Young's modulus E of the developer regulating member is equal to or greater than $6.8\times10^{10}$ Pa.

9. The developing device according to claim 1, wherein the developing device is detachably attachable to an apparatus body of the image forming apparatus.

10. A process cartridge that is detachably attachable to an apparatus body of an image forming apparatus, comprising:

an image carrying member that carries an electrostatic latent image;

a developer carrying member that carries a developer to develop the electrostatic latent image;

a developer regulating member that includes a plate-shaped elastic member, is rotatably supported, and brings the elastic member into contact with the developer carrying member such that a leading edge of the elastic member faces an upstream side, in a rotation direction, of the developer carrying member to regulate the amount of developer held in the developer carrying member; and an urging portion that applies a moment to the developer regulating member to bring the developer regulating member into pressure contact with the developer carrying member, wherein a distance from a rotation center of the developer regulating member to a center of the developer carrying member is set to be more than a distance from the rotation center of the developer regulating member to the leading edge of the elastic member, and when a load received by the developer regulating member due to contact between the developer carrying member is P (N), a free length of the developer regulating member is L (m), a Young's modulus of the developer regulating member is E (Pa), a second moment of area of the developer regulating member is I ($m^4$), and an angle formed between the elastic member and a tangent line to the developer carrying member in a contact portion between the leading edge of the developer regulating member and the developer regulating member at the time when the elastic member comes into contact with the developer carrying member without receiving the load is a set angle α (rad), a bending angle β of the elastic member calculated from the following Expression 1 is less than the set angle α:

$$\beta = PL^2/2EI \quad (1).$$

11. The process cartridge according to claim 10, wherein the elastic member is made of a metal material.

12. The process cartridge according to claim 10, wherein the developer regulating member includes a supporting member that supports the elastic member, and the urging portion applies an urging force to the supporting member.

13. The process cartridge according to claim 12, wherein the supporting member is a bent metal plate and includes a first surface to which the elastic member is fixed and a second surface which intersects the first surface and receives the urging force from the urging portion.

14. The process cartridge according to claim 10, wherein the urging unit applies an urging force to the developer regulating member in a direction in which the elastic member extends to the developer carrying member.

15. The process cartridge according to claim 10, wherein the rotation center of the developer regulating member and the rotation center of the developer carrying member are disposed on a same side of the elastic member.

16. The process cartridge according to claim 10, wherein the developer regulating member includes a supporting member that supports the elastic member, and the rotation center of the developer regulating member is arranged at a position to overlap the supporting member in a plane perpendicular to an axial line of the developer carrying member.

17. The process cartridge according to claim 10, wherein the Young's modulus E of the developer regulating member is equal to or greater than $6.8\times10^{10}$ Pa.

18. An image forming apparatus that forms an image on a recording medium, comprising:

a process cartridge that is detachably attachable to an apparatus body of the image forming apparatus, wherein the process cartridge includes:

an image carrying member that carries an electrostatic latent image;

a developer carrying member that carries a developer to develop the electrostatic latent image;

a developer regulating member that includes a plate-shaped elastic member, is rotatably supported, and brings the elastic member into contact with the developer carrying member such that a leading edge of the elastic member faces an upstream side, in a rotation direction, of the developer carrying member to regulate the amount of developer held in the developer carrying member; and an urging portion that applies a moment to the developer regulating member to bring the developer regulating member into pressure contact with the developer carrying member, wherein a distance from a rotation center of the developer regulating member to a center of the developer carrying member is set to be more than a distance from the rotation center of the developer regulating member to the leading edge of the elastic member, and when a load received by the developer regulating member due to contact between the developer carrying member is P (N), a free length of the developer regulating member is L (m), a Young's modulus of the developer regulating member is E (Pa), a second moment of area of the developer regulating member is I ($m^4$), and an angle formed between the elastic member and a tangent line to the developer carrying member in a contact portion between the leading edge of the developer regulating member and the developer regulating member at the time when the elastic member comes into contact with the developer carrying member without receiving the load is a set angle $\alpha$ (rad), a bending angle $\beta$ of the elastic member calculated from the following Expression 1 is less than the set angle $\alpha$:

$$\beta=PL^2/2EI \quad (1).$$

19. The image forming apparatus according to claim 18, wherein the developer regulating member includes a supporting member that supports the elastic member, and the urging portion applies an urging force to the supporting member.

20. The image forming apparatus according to claim 19, wherein the supporting member is a bent metal plate and includes a first surface to which the elastic member is fixed and a second surface which intersects the first surface and receives the urging force from the urging portion.

* * * * *